US009944861B2

(12) United States Patent
Narula et al.

(10) Patent No.: US 9,944,861 B2
(45) **Date of Patent: *Apr. 17, 2018**

(54) CATALYTIC CONVERSION OF ALCOHOLS HAVING AT LEAST THREE CARBON ATOMS TO HYDROCARBON BLENDSTOCK

(71) Applicant: UT-BATTELLE, LLC, Oak Ridge, TN (US)

(72) Inventors: Chaitanya K. Narula, Knoxville, TN (US); Brian H. Davison, Knoxville, TN (US)

(73) Assignee: UT-BATTELLE, LLC, Oak Ridge ( * ) Notice: Subject to any disclaimer, the term of this patent is extended or adjusted under 35 U.S.C. 154(b) by 105 days.

This patent is subject to a terminal disclaimer.

(21) Appl. No.: 14/878,663

(22) Filed: Oct. 8, 2015

(65) Prior Publication Data

US 2016/0032195 A1 Feb. 4, 2016

Related U.S. Application Data

(63) Continuation of application No. 14/321,012, filed on Jul. 1, 2014, now Pat. No. 9,181,493.

(60) Provisional application No. 61/842,048, filed on Jul. 2, 2013.

(51) Int. Cl.

| | |
|---|---|
| ***B01J 29/42*** | (2006.01) |
| ***B01J 29/48*** | (2006.01) |
| ***C10G 3/00*** | (2006.01) |
| ***C10G 45/44*** | (2006.01) |
| ***C10G 50/00*** | (2006.01) |

(52) U.S. Cl.

CPC ..... *C10G 3/49* (2013.01); *C10G 3/00* (2013.01); *C10G 3/45* (2013.01); *C10G 45/44* (2013.01); *C10G 50/00* (2013.01); *C10G 2400/02* (2013.01); *C10G 2400/20* (2013.01); *C10G 2400/22* (2013.01)

(58) Field of Classification Search

None

See application file for complete search history.

(56) References Cited

U.S. PATENT DOCUMENTS

| | | | |
|---|---|---|---|
| 3,702,886 | A | 11/1972 | Argauer et al. |
| 3,894,107 | A | 7/1975 | Butter et al. |
| 3,899,544 | A | 8/1975 | Chang et al. |
| 3,928,483 | A | 12/1975 | Chang et al. |
| 3,931,349 | A | 1/1976 | Keo |
| 3,969,427 | A | 7/1976 | Bell et al. |
| 3,998,899 | A | 12/1976 | Daviduk et al. |
| 4,025,571 | A | 5/1977 | Lago |
| 4,035,430 | A | 7/1977 | Dwyer et al. |
| 4,028,576 | A | 11/1977 | Chang et al. |
| 4,058,576 | A | 11/1977 | Chang et al. |
| 4,071,573 | A | 1/1978 | Owen et al. |
| 4,138,440 | A | 2/1979 | Chang et al. |
| 4,148,835 | A | 4/1979 | Chen et al. |
| 4,278,565 | A | 7/1981 | Chen et al. |
| 4,338,475 | A | 7/1982 | Pennington et al. |
| 4,404,414 | A | 9/1983 | Penick et al. |
| 4,423,274 | A | 12/1983 | Daviduk et al. |
| 4,427,789 | A | 1/1984 | Miale et al. |
| 4,499,327 | A | 2/1985 | Kaiser |
| 4,524,234 | A | 6/1985 | Kaiser |
| 4,596,704 | A | 6/1986 | Miale et al. |
| 4,608,355 | A | 8/1986 | Chu |
| 4,721,609 | A | 1/1988 | Baack et al. |
| 4,727,214 | A | 2/1988 | Uytterhoeven et al. |
| 4,788,042 | A | 11/1988 | Marsh et al. |
| 4,788,369 | A | 11/1988 | Marsh et al. |
| 4,849,093 | A | 7/1989 | Vauk et al. |
| 4,861,937 | A | 8/1989 | Baacke et al. |
| 5,041,690 | A | 8/1991 | Harandi et al. |
| 5,045,287 | A | 9/1991 | Harandi et al. |
| 5,177,279 | A | 1/1993 | Harandi |
| 5,314,665 | A | 5/1994 | Iwasa |
| 5,491,270 | A | 2/1996 | Chin et al. |
| 5,773,676 | A | 6/1998 | Drake et al. |
| 6,046,373 | A | 4/2000 | Sun |
| 6,323,383 | B1 | 11/2001 | Tsuchida et al. |

(Continued)

FOREIGN PATENT DOCUMENTS

| | | | |
|---|---|---|---|
| CN | 100337998 | C | 9/2007 |
| CN | 101454423 | A | 6/2009 |

(Continued)

OTHER PUBLICATIONS

U.S. Office Action issued in U.S. Appl. No. 14/263,257 dated Aug. 19, 2015.

English-language translation of the Office Action dated Nov. 15, 2014 received from the Chinese Patent Office in Application No. 201280036737.8.

Schulz, J. et al., "Conversion of Ethanol Over Metal-Exchanged Zeolites", Chem. Eng. Technol. 16:332-337 (1993).

U.S. Final Office Action dated Jan. 27, 2015 in U.S. Appl. No. 14/293,248.

(Continued)

*Primary Examiner* — Philip Louie

(74) *Attorney, Agent, or Firm* — Scully Scott Murphy & Presser

(57) ABSTRACT

A method for producing a hydrocarbon blendstock, the method comprising contacting at least one saturated acyclic alcohol having at least three and up to ten carbon atoms with a metal-loaded zeolite catalyst at a temperature of at least 100° C. and up to 550° C., wherein the metal is a positively-charged metal ion, and the metal-loaded zeolite catalyst is catalytically active for converting the alcohol to the hydrocarbon blendstock, wherein the method directly produces a hydrocarbon blendstock having less than 1 vol % ethylene and at least 35 vol % of hydrocarbon compounds containing at least eight carbon atoms.

23 Claims, No Drawings

(56) References Cited

U.S. PATENT DOCUMENTS

| | | | | |
|---|---|---|---|---|
| 6,426,442 | B1 | 7/2002 | Gladrow et al. | |
| 7,438,868 | B2 | 10/2008 | Kato | |
| 7,442,425 | B2 | 10/2008 | Fu et al. | |
| 7,459,413 | B2 | 12/2008 | Shen et al. | |
| 7,872,054 | B2 | 1/2011 | Cortright et al. | |
| 2003/0171630 | A1 | 9/2003 | Winder et al. | |
| 2007/0087934 | A1 | 4/2007 | Martens et al. | |
| 2008/0103345 | A1 | 5/2008 | Levin et al. | |
| 2008/0275283 | A1* | 11/2008 | Gracey | C07C 1/24 585/639 |
| 2008/0287720 | A1 | 11/2008 | Clark | |
| 2010/0185033 | A1 | 7/2010 | Karim et al. | |
| 2010/0204455 | A1 | 8/2010 | Gervais et al. | |
| 2010/0268000 | A1* | 10/2010 | Parekh | C12P 7/065 568/840 |
| 2011/0061290 | A1 | 3/2011 | Aulich et al. | |
| 2011/0152513 | A1 | 6/2011 | Yao et al. | |
| 2012/0198760 | A1 | 8/2012 | Blommel et al. | |
| 2013/0217935 | A1 | 8/2013 | Adam et al. | |
| 2014/0148630 | A1 | 5/2014 | Adam et al. | |
| 2014/0171691 | A1 | 6/2014 | Kortan et al. | |

FOREIGN PATENT DOCUMENTS

| | | | |
|---|---|---|---|
| EA | 006785 | B1 | 2/2005 |
| EP | 0099650 | A1 | 2/1984 |
| EP | 0130368 | A1 | 1/1985 |
| RU | 2 082 500 | C1 | 6/1997 |
| WO | 90/12855 | A1 | 11/1990 |
| WO | WO 2007/112314 | A2 | 10/2007 |
| WO | WO 2008/069841 | A2 | 6/2008 |
| WO | WO 2008/069984 | A2 | 6/2008 |
| WO | WO 2009/021726 | A1 | 2/2009 |
| WO | WO 2012/016787 | A1 | 2/2012 |
| WO | WO 2012/174205 | A1 | 12/2012 |
| WO | WO 2012174205 | A1 | 12/2012 |
| WO | WO 2013/014081 | A1 | 1/2013 |

OTHER PUBLICATIONS

U.S. Office Action dated Jan. 13, 2015 in U.S. Appl. No. 14/263,257.

Supplementary Extended European Search Report dated Nov. 24, 2014 received from EP Application No. 12799829.2.

International Search Report and Written Opinion dated Oct. 30, 2014 received from International Application No. PCT/US2014/044999.

U.S. Office Action dated Oct. 21, 2014 in related U.S. Appl. No. 14/123,363.

U.S. Office Action dated Oct. 3, 2014 in related U.S. Appl. No. 14/293,248.

Office Action dated Dec. 15, 2015 received in related U.S. Patent Application, namely U.S. Appl. No. 13/787,112.

Le Van Mao, R. et al., "Ethylene From Ethanol Over Zeolite Catalysts", Applied Catalysis, (1987), vol. 34, pp. 163-179.

Le Van Mao, R. et al., "Conversion of Light Alcohols to Hydrocarbons over ZSM-5 Zeolite and Asbestos-Derived Zeolite Catalysts", Energy & Fuels, (1989), vol. 3, No. 5, pp. 620-624.

Supplementary European Search Report dated Feb. 3, 2017 issued in corresponding European Patent Application No. EP 14 81 9577.

Chinese Office Action dated Jun. 6, 2016 issued in Chinese Patent Application No. 201480037755.7.

* cited by examiner

CATALYTIC CONVERSION OF ALCOHOLS HAVING AT LEAST THREE CARBON ATOMS TO HYDROCARBON BLENDSTOCK

CROSS REFERENCE TO RELATED APPLICATIONS

The present application is a continuation application of U.S. Ser. No. 14/321,012 filed Jul. 1, 2014 which claims benefit of U.S. Provisional Application No. 61/842,048, filed on Jul. 2, 2013, all of the contents of which are incorporated herein by reference.

This invention was made with government support under Prime Contract No. DE-AC05-00OR22725 awarded by the U.S. Department of Energy. The government has certain rights in the invention.

FIELD OF THE INVENTION

The present invention relates, generally, to the catalytic conversion of alcohols to hydrocarbons, and more particularly, to zeolite-based catalytic methods for such conversion.

BACKGROUND OF THE INVENTION

As part of a continuing effort in finding more cost effective, environmentally friendly, and independent solutions to fuel production and consumption, the conversion of ethanol to hydrocarbons has become an active field of study. Ethanol is of primary interest as an alcohol feedstock because it has the potential to be made in large quantity by renewable means (e.g., fermentation of biomass). However, several hurdles need to be overcome before such a process can become industrially feasible for producing hydrocarbon blendstocks of substantial equivalence to gasoline and other petrochemical fuels.

A particular drawback in the use of ethanol in catalytic conversion is its tendency to produce a significant quantity of ethylene, which is generally an undesirable component in a hydrocarbon fuel. Moreover, whereas a hydrocarbon blendstock weighted in the higher hydrocarbons (e.g., of at least eight carbon atoms) is more desirable, conversion of ethanol generally results in hydrocarbon blendstock more weighted in the lower hydrocarbons (e.g., of less than eight carbon atoms).

SUMMARY OF THE INVENTION

The invention is directed to an alcohol-to-hydrocarbon catalytic conversion method that advantageously produces a hydrocarbon blendstock having substantially less ethylene and greater relative amount of higher hydrocarbons, particularly those hydrocarbons having at least 6, 7, 8, 9, or 10 carbon atoms, as compared to blendstock produced from ethanol or methanol. The invention accomplishes this by catalytically converting at least one saturated acyclic alcohol having at least three and up to ten carbon atoms (hereinafter, a "$C_{3+}$ alcohol"). In different embodiments, the alcohol feedstock is exclusively or includes a single $C_{3+}$ alcohol, or is exclusively or includes a mixture of two or more $C_{3+}$ alcohols, or is exclusively or includes a mixture of at least one $C_{3+}$ alcohol and ethanol and/or methanol. Moreover, the resulting hydrocarbon blendstock may be used directly as a fuel, or in other embodiments, may be mixed with another hydrocarbon blendstock or fuel (e.g., straight run or reformate gasoline) to suitably adjust the composition of the final blendstock in any desired characteristics, such as olefin content, aromatics content, or octane rating.

In more specific embodiments, the method includes contacting at least one saturated acyclic alcohol having at least three and up to ten carbon atoms ($C_{3+}$ alcohol) with a metal-loaded zeolite catalyst at a temperature of at least 100° C. and up to 550° C., wherein the metal is a positively-charged metal ion, and the metal-loaded zeolite catalyst is catalytically active for converting the $C_{3+}$ alcohol (or "alcohol feedstock" in general) to hydrocarbon blendstock. The resulting hydrocarbon blendstock preferably contains less than 1 or 0.5 vol % ethylene while also containing at least 30, 35, 40, 45, 50, 55, 60, 65, 70, or 75 vol % of hydrocarbon compounds containing at least six, seven, eight, nine, or ten carbon atoms.

An additional advantage of the method described herein is that it can be practiced without requiring the alcohol to be in a pure or unadulterated state, as long as the other included components do not substantially hinder the process from achieving the hydrocarbon blendstock describe above in a feasible manner. For example, by the method described herein, effective conversion can be accomplished on aqueous solutions of an alcohol, including, for example, the fermentation stream of a biomass fermentation reactor. At least two $C_{3+}$ alcohols that may be produced by fermentation include butanol and isobutanol. In different embodiments, the aqueous solution of alcohol can have a high concentration of alcohol (e.g., pure alcohol or over 50%), a moderate concentration of alcohol (e.g., at least 20% and up to 30%, 40%, or 50%), or a low concentration of alcohol (e.g., up to or less than 10% or 5%). The aqueous solution may alternatively be a saturated solution of the alcohol or mixture of alcohols. As some $C_{3+}$ alcohols have a low solubility or are substantially insoluble in water, the alcohol may alternatively be admixed with water in a biphasic form, which may be, for example, two separate bulk layers or a suspension of one phase (e.g., the alcohol) in the other (e.g., water). The ability of the described method to convert aqueous solutions of alcohol is particularly advantageous since concentration and/or distillation of alcohol from a fermentation stream (as practiced in current technologies) is highly energy intensive and largely offsets gains made in the initial low cost of using a bio-alcohol.

DETAILED DESCRIPTION OF THE INVENTION

As used herein, the term "about" generally indicates within ±0.5%, 1%, 2%, 5%, or up to ±10% of the indicated value. For example, a concentration of about 20% generally indicates in its broadest sense 20±2%, which indicates 18-22%. In addition, the term "about" can indicate either a measurement error (i.e., by limitations in the measurement method), or alternatively, a variation or average in a physical characteristic of a group.

In the conversion method described herein, at least one saturated acyclic alcohol having at least three and up to ten carbon atoms (i.e., "$C_{3+}$ alcohol") is catalytically converted to a hydrocarbon blendstock by contacting the $C_{3+}$ alcohol with a metal-loaded zeolite catalyst at conditions (particularly, temperature and choice of catalyst) suitable to effect said conversion. As used herein, the term "$C_{3+}$ alcohol" is meant to include a single alcohol or a mixture of two or more alcohols. The $C_{3+}$ alcohol can be straight-chained or branched. Some examples of straight-chained $C_{3+}$ alcohols include n-propanol, n-butanol, n-pentanol, n-hexanol, n-heptanol, n-octanol, n-nonanol, and n-decanol. Some examples of branched $C_{3+}$ alcohols include isopropanol, isobutanol, sec-butanol, t-butanol, isopentanol, 2-pentanol, 3-pentanol, neopentyl alcohol, isohexanol, 2-hexanol, 3-hexanol, isoheptanol, 2-heptanol, 3-heptanol, 4-heptanol, 6-methylheptanol, and 2-ethylhexanol.

In a first set of embodiments, the alcohol used in the catalytic conversion method is exclusively a single $C_{3+}$ alcohol. In a second set of embodiments, the alcohol used in the catalytic conversion method includes or is exclusively a mixture of two or more $C_{3+}$ alcohols. In a third set of embodiments, the alcohol used in the catalytic conversion method includes a mixture of one, two, or more $C_{3+}$ alcohols in combination with ethanol and/or methanol. In some embodiments, the alcohol used in the catalytic conversion method is one that can be produced by a fermentation process (i.e., a bio-alcohol). Some examples of $C_{3+}$ alcohols that can be produced by a fermentation process include butanol and isobutanol. In a fermentation stream, the butanol and/or isobutanol is typically also accompanied by ethanol, although the amount of ethanol and/or methanol may be suitably reduced or even substantially eliminated (e.g., up to or less than 10%, 8%, 5%, 4%, 3%, 2%, or 1%) by methods known in the art, such as evaporation or distillation. In particular embodiments, the alcohol is a component of an aqueous solution or biphasic system as found in fermentation streams. In fermentation streams, the alcohol is typically in a concentration of no more than (up to) about 20% (vol/vol), 15%, 10%, or 5%. In some embodiments, a fermentation stream is directly contacted with the catalyst (typically, after filtration to remove solids) to effect the conversion of the alcohol in the fermentation stream. In other embodiments, the aqueous solution of alcohol is more concentrated in alcohol (for example, of at least or up to 30%, 40%, 50%, 60%, 70%, 80%, 90%, 95%) or is an aqueous saturated solution of the alcohol before contacting the aqueous solution with the catalyst. The more concentrated aqueous solution can be obtained by, for example, concentrating a fermentation stream, such as by distillation, or by mixing concentrated or pure alcohol or a mixture thereof with water. In yet other embodiments, the alcohol is in the form of substantially dewatered alcohol (e.g., 98%, 99%, or 100% alcohol) when contacting the catalyst.

Although a wide variety of hydrocarbon product can be produced by the described method, the hydrocarbon blend primarily considered herein typically includes saturated hydrocarbons, and more particularly, hydrocarbons in the class of alkanes, which may be straight-chained, or branched, or a mixture thereof, particularly when the hydrocarbon product is to be used as a fuel. The alkanes may include those containing at least four, five, six, seven, or eight carbon atoms, and up to ten, eleven, twelve, fourteen, sixteen, seventeen, eighteen, or twenty carbon atoms. Some examples of straight-chained alkanes include n-butane, n-pentane, n-hexane, n-heptane, n-octane, n-nonane, n-decane, n-undecane, n-dodecane, n-tridecane, n-tetradecane, n-pentadecane, n-hexadecane, n-heptadecane, n-octadecane, n-nonadecane, and n-eicosane. Some examples of branched alkanes include isobutane, isopentane, neopentane, isohexane, 3-methylpentane, 2,3-dimethylbutane, 2,2-dimethylbutane, 2-methylhexane, 3-methylhexane, 2,2-dimethylpentane, 2,3-dimethylpentane, 2,4-dimethylpentane, 3,3-dimethylpentane, 2-methylheptane, and 2,2,4-trimethylpentane (isooctane). Some other hydrocarbon products that may be produced by the instant method include olefins (i.e., alkenes, such as, for example, ethylene, propylene, 1-butene, 2-butene, 2-methyl-1-propene, 2-methyl-2-butene, cyclobutenes, and cyclopentenes) and aromatics (for example, benzenes, toluenes, xylenes, styrenes, and naphthalenes).

The hydrocarbon blendstock particularly considered herein is a mixture of hydrocarbon compounds either directly useful as a fuel or as an additive or component of a fuel. In some embodiments, the hydrocarbon blendstock produced herein substantially corresponds (e.g., in composition and/or properties) to a known petrochemical fuel, such as petroleum, or a fractional distillate of petroleum. Some examples of petrochemical fuels include gasoline, kerosene, diesel, and jet propellant (e.g., JP-8). In other embodiments, the hydrocarbon blendstock produced herein is admixed with another hydrocarbon blendstock or fuel (e.g., gasoline) produced by the same or another method of the art in an effort to provide a final fuel product with a combination of properties (for example, relative low ethylene content and low aromatics content, or relative low ethylene content and high aromatics content, or relative high ethylene content and low aromatics content, or relative high ethylene and aromatics content). A low ethylene content generally corresponds to an ethylene content of less than 1%, or up to or less than 0.9%, 0.8%, 0.7%, 0.6%, 0.5%, 0.4%, 0.3%, or 0.2% (vol/vol). A high ethylene content generally corresponds to an ethylene content of above 1%, or at least or above 1.5%, 2%, 2.5%, 3%, 3.5%, 4%, 4.5%, 5%, 6%, 7%, 8%, 9%, or 10%. A low aromatics content generally corresponds to an aromatics content of up to or less than 40%, 35%, 30%, 25%, 20%, 15%, or 10%. A high aromatics content generally corresponds to an aromatics content of at least or above 45%, 50%, 55%, 60%, 65%, 70%, or 75%. In some embodiments, the hydrocarbon blendstock directly produced from conversion of the alcohol (i.e., without admixing into another blendstock or fuel and without further processing, such as distillation) may have any one or more of the foregoing ethylene and/or aromatics contents. In other embodiments, with specific reference to benzene, the hydrocarbon blendstock may have a benzene content of up to or less than 5%, 4%, 3%, 2%, 1%, 0.5%, 0.4%, or 0.3% (vol/vol).

Like hydrocarbon fuel grades in current use, the mixture of hydrocarbon compounds produced herein can, in some embodiments, be predominantly or exclusively composed of alkanes, alkenes, aromatics, or a mixture thereof. Although ethylene and aromatics (particularly benzene) may be present in the hydrocarbon blendstock, their presence may be reduced or minimized to adhere to current fuel standards. The relative amounts of ethylene and/or aromatics in the produced hydrocarbon blendstock may be suitably reduced by, for example, distillation or fractionation. The fractionation may also serve to produce different fuel grades, each of which is known to be within a certain boiling point range. A particular advantage of the instant method is its ability to produce such fuel grades in the substantial absence of contaminants (e.g., mercaptans) normally required to be removed during the petroleum refining process. Moreover, by appropriate adjustment of the catalyst and processing conditions, a select distribution of hydrocarbons can be obtained.

The composition of the one or more alcohols in the alcohol feedstock can also advantageously be suitably selected or optimized to produce a hydrocarbon blendstock of desired or optimal ethylene content, aromatics (for example, benzene) content, octane rating, and relative weight ratios of hydrocarbon based on carbon number. In particular, mixtures of alcohols can be used to provide a combination of features that cannot be provided by use of a single alcohol. For example, an alcohol that provides a suitably low ethylene content and high aromatics content can be admixed in suitable proportions with an alcohol that provides a higher ethylene content and lower aromatics content to produce a hydrocarbon blendstock with more optimized ethylene and aromatic contents.

In some embodiments, the aromatics content (or more particularly, benzene content) of the hydrocarbon blendstock is reduced by chemical reaction, for example, by partial hydrogenation or alkylation, as well known in the art, to bring the aromatics (or benzene) content to within regulatory limits. In the U.S., the Environmental Protection Agency (EPA) has recently imposed a benzene limit of 0.62 vol %. Thus, the resulting hydrocarbon blendstock may be adjusted to have a benzene content of up to or less than 0.62 vol %, particularly if it is to be used directly as a fuel. In the case of alkylation, the hydrocarbon blendstock produced by the method described herein can be treated by any of the alkylation catalysts known in the art, including zeolite alkylation catalysts and Friedel-Crafts type of catalysts.

Depending on the final composition of the hydrocarbon product, the product can be used for a variety of purposes other than as fuel. Some other applications include, for example, precursors for plastics, polymers, and fine chemicals. The process described herein can advantageously produce a range of hydrocarbon products that differ in any of a variety of characteristics, such as molecular weight (i.e., hydrocarbon weight distribution), degree of saturation or unsaturation (e.g., alkane to alkene ratio), and level of branched or cyclic isomers. The process provides this level of versatility by appropriate selection of, for example, the composition of the alcohol, composition of the catalyst (including choice of catalytic metal), amount of catalyst (e.g., ratio of catalyst to alcohol precursor), processing temperature, and flow rate (e.g., LHSV).

In different embodiments, the alcohol or admixture thereof used in the conversion reaction is selected to directly produce a hydrocarbon blendstock that contains hydrocarbons of at least six, seven, eight, nine, or ten carbon atoms in a relative amount of at least 30%, 35%, 40%, 45%, 50%, 55%, 60%, 65%, 70%, or 75% (vol/vol). Preferably, the alcohol or admixture thereof results in any of the foregoing weight distributions of hydrocarbons along with any of the preferred ethylene contents provided above, particularly an ethylene content of less than 1% or 0.5%. In other preferred embodiments, the alcohol or admixture thereof results in any of the foregoing weight distributions of hydrocarbons along with up to or less than 10%, 9%, 8%, 7%, 6%, 5%, 4%, or 3% of hydrocarbon compounds containing three carbon atoms or the sum of hydrocarbon compounds containing two or three carbon atoms.

In the process, a suitable reaction temperature is employed during contact of the alcohol with the catalyst. Generally, the reaction temperature is at least 100° C. and up to 550° C. In different embodiments, the reaction temperature is precisely or about, for example, 100° C., 125° C., 150° C., 175° C., 200° C., 225° C., 250° C., 275° C., 300° C., 325° C., 350° C., 375° C., 400° C., 425° C., 450° C., 475° C., 500° C., 525° C., or 550° C., or a temperature within a range bounded by any two of the foregoing exemplary temperatures (e.g., 100° C.-550° C., 200° C.-550° C., 300° C.-550° C., 400° C.-550° C., 450° C.-550° C., 100° C.-500° C., 200° C.-500° C., 300° C.-500° C., 350° C.-500° C., 400° C.-500° C., 450° C.-500° C., 100° C.-450° C., 200° C.-450° C., 300° C.-450° C., 350° C.-450° C., 400° C.-450° C., 100° C.-425° C., 200° C.-425° C., 300° C.-425° C., 350° C.-425° C., 375° C.-425° C., 400° C.-425° C., 100° C.-400° C., 200° C.-400° C., 300° C.-400° C., 350° C.-400° C., and 375° C.-400° C.).

Generally, ambient (i.e., normal atmospheric) pressure of about 1 atm is used in the method described herein. However, in some embodiments, an elevated pressure or reduced pressure may be used. For example, in some embodiments, the pressure may be elevated to, for example, 1.5, 2, 3, 4, or 5 atm, or reduced to, for example, 0.5, 0.2, or 0.1 atm.

The catalyst and reactor can have any of the designs known in the art for catalytically treating a fluid or gas at elevated temperatures, such as a fluidized bed reactor. The process may be in a continuous or batch mode. In particular embodiments, the alcohol is injected into a heated reactor such that the alcohol is quickly volatilized into gas, and the gas passed over the catalyst. In some embodiments, the reactor design includes a boiler unit and a reactor unit if a fermentation stream is used directly as a feedstock without purification. The boiler unit is generally not needed if the fermentation stream is distilled to concentrate the alcohol because the distillation process removes the dissolved solids in the fermentation streams. The boiler unit volatilizes liquid feedstock into gases prior to entry into the reactor unit and withholds dissolved solids.

In some embodiments, the conversion method described above is integrated with a fermentation process, wherein the fermentation process produces the alcohol used as feedstock for the conversion process. By being "integrated" is meant that alcohol produced at a fermentation facility or zone is sent to and processed at a conversion facility or zone (which performs the conversion process described above). Preferably, in order to minimize production costs, the fermentation process is in close enough proximity to the conversion facility or zone, or includes appropriate conduits for transferring produced alcohol to the conversion facility or zone, thereby not requiring the alcohol to be shipped. In particular embodiments, the fermentation stream produced in the fermentation facility is directly transferred to the conversion facility, generally with removal of solids from the raw stream (generally by filtration or settling) before contact of the stream with the catalyst.

In some embodiments, the fermentation process is performed in an autonomous fermentation facility, i.e., where saccharides, produced elsewhere, are loaded into the fermentation facility to produce alcohol. In other embodiments, the fermentation process is part of a larger biomass reactor facility, i.e., where biomass is decomposed into fermentable saccharides, which are then processed in a fermentation zone. Biomass reactors and fermentation facilities are well known in the art. Biomass often refers to lignocellulosic matter (i.e., plant material), such as wood, grass, leaves, paper, corn husks, sugar cane, bagasse, and nut hulls. Generally, biomass-to-ethanol conversion is performed by 1) pretreating biomass under well-known conditions to loosen lignin and hemicellulosic material from cellulosic material, 2) breaking down the cellulosic material into fermentable saccharide material by the action of a cellulase enzyme, and 3) fermentation of the saccharide material, typically by the action of a fermenting organism, such as a yeast.

In other embodiments, the alcohol is produced from a more direct sugar source, such as a plant-based source of sugars, such as sugar cane or a grain starch (such as corn starch). Ethanol production via corn starch (i.e., corn starch ethanol) and via sugar cane (i.e., cane sugar ethanol) currently represent some of the largest commercial production methods of ethanol. Such large scale fermentation processes may also produce $C_{3+}$ alcohols, particularly butanol and/or isobutanol. Integration of the instant conversion process with any of these large scale alcohol production methods is contemplated herein.

The conversion catalyst used herein includes a zeolite portion and a metal loaded into the zeolite. The zeolite considered herein can be any of the porous aluminosilicate structures known in the art that are stable under high temperature conditions, i.e., of at least 100° C., 150° C., 200° C., 250° C., 300° C., and higher temperatures up to, for example, 500° C., 550° C., 600° C., 650° C., 700° C., 750° C., 800° C., 850° C., or 900° C. In particular embodiments, the zeolite is stable from at least 100° C. and up to 700° C. Typically, the zeolite is ordered by having a crystalline or partly crystalline structure. The zeolite can generally be described as a three-dimensional framework containing silicate ($SiO_2$ or $SiO_4$) and aluminate ($Al_2O_3$ or $AlO_4$) units that are interconnected (i.e., crosslinked) by the sharing of oxygen atoms.

The zeolite can be microporous (i.e., pore size of less than 2 μm), mesoporous (i.e., pore size within 2-50 μm, or sub-range therein), or a combination thereof. In several embodiments, the zeolite material is completely or substantially microporous. By being completely or substantially microporous, the pore volume due to micropores can be, for example, 100%, or at least 95%, 96%, 97%, 98%, 99%, or 99.5%, with the remaining pore volume being due to mesopores, or in some embodiments, macropores (pore size greater than 50 μm). In other embodiments, the zeolite material is completely or substantially mesoporous. By being completely or substantially mesoporous, the pore volume due to mesopores can be, for example, 100%, or at least 95%, 96%, 97%, 98%, 99%, or 99.5%, with the remaining pore volume being due to micropores, or in some embodiments, macropores. In yet other embodiments, the zeolite material contains an abundance of both micropores and mesopores. By containing an abundance of both micropores and mesopores, the pore volume due to mesopores can be, for example, up to, at least, or precisely 50%, 60%, 70%, 80%, or 90%, with the pore volume balance being due to micropores, or vice-versa.

In various embodiments, the zeolite is a MFI-type zeolite, MEL-type zeolite, MTW-type zeolite, MCM-type zeolite, BEA-type zeolite, kaolin, or a faujasite-type of zeolite. Some particular examples of zeolites include the ZSM class of zeolites (e.g., ZSM-5, ZSM-8, ZSM-11, ZSM-12, ZSM-15, ZSM-23, ZSM-35, ZSM-38, ZSM-48), zeolite X, zeolite Y, zeolite beta, and the MCM class of zeolites (e.g., MCM-22 and MCM-49). The compositions, structures, and properties of these zeolites are well-known in the art, and have been described in detail, as found in, for example, U.S. Pat. Nos. 4,721,609, 4,596,704, 3,702,886, 7,459,413, and 4,427,789, the contents of which are incorporated herein by reference in their entirety.

The zeolite can have any suitable silica-to-alumina (i.e., $SiO_2/Al_2O_3$ or "Si/Al") ratio. For example, in various embodiments, the zeolite can have a Si/Al ratio of precisely, at least, less than, or up to 1, 2, 3, 4, 5, 6, 7, 8, 9, 10, 11, 12, 13, 14, 15, 20, 25, 30, 35, 40, 45, 50, 55, 60, 65, 70, 75, 80, 85, 90, 95, 100, 120, 150, or 200, or a Si/Al ratio within a range bounded by any two of the foregoing values. In particular embodiments, the zeolite possesses a Si/Al ratio of 1 to 45.

In particular embodiments, the zeolite is ZSM-5. ZSM-5 belongs to the pentasil-containing class of zeolites, all of which are also considered herein. In particular embodiments, the ZSM-5 zeolite is represented by the formula $Na_nAl_nSi_{96-n}O_{192}.16H_2O$, wherein $0<n<27$.

Typically, the zeolite contains an amount of cationic species. As is well known in the art, the amount of cationic species is generally proportional to the amount of aluminum in the zeolite. This is because the replacement of silicon atoms with lower valent aluminum atoms necessitates the presence of countercations to establish a charge balance. Some examples of cationic species include hydrogen ions ($H^+$), alkali metal ions, alkaline earth metal ions, and main group metal ions. Some examples of alkali metal ions that may be included in the zeolite include lithium ($Li^+$), sodium ($Na^+$), potassium ($K^+$), rubidium ($Rb^+$), and cesium ($Cs^+$). Some examples of alkaline earth metal ions that may be included in the zeolite include ($Be^{2+}$), magnesium ($Mg^{2+}$), calcium ($Ca^{2+}$), strontium ($Sr^{2+}$), and barium ($Ba^{2+}$). Some examples of main group metal ions that may be included in the zeolite include boron ($B^{3+}$), gallium ($Ga^{3+}$), indium ($In^{3+}$), and arsenic ($As^{3+}$). In some embodiments, a combination of cationic species is included. The cationic species can be in a trace amount (e.g., no more than 0.01 or 0.001%), or alternatively, in a significant amount (e.g., above 0.01%, and up to, for example, 0.1, 0.5, 1, 2, 3, 4, or 5% by weight of the zeolite). In some embodiments, any one or more of the above classes or specific examples of cationic species are excluded from the zeolite.

The zeolite described above is loaded with a catalytic metal in a catalytically effective concentration. The metal loaded into the zeolite is selected such that the resulting metal-loaded zeolite is catalytically active, under conditions set forth above, for converting an alcohol to a hydrocarbon. Typically, the metal considered herein is in the form of positively-charged metal ions (i.e., metal cations). The metal cations can be, for example, monovalent, divalent, trivalent, tetravalent, pentavalent, or hexavalent. In some embodiments, the metal is (or includes) alkali metal ions. In other embodiments, the metal is (or includes) alkaline earth metal ions. In other embodiments, the metal is (or includes) a transition metal, such as one or more first, second, or third row transition metals. Some preferred transition metals include copper, iron, zinc, titanium, vanadium, and cadmium. The copper ions can be cuprous ($Cu^{+1}$) or cupric ($Cu^{+2}$) in nature, and the iron atoms can be ferrous ($Fe^{+2}$) or ferric ($Fe^{+3}$) in nature. Vanadium ions may be in any of its known oxidation states, e.g., $V^{+2}$, $V^{+3}$, $V^{+4}$, and $V^{+5}$. In other embodiments, the metal is (or includes) a catalytically active main group metal, such as gallium or indium. A single metal or a combination of metals may be loaded into the zeolite. In other embodiments, any one or more metals described above are excluded from the zeolite.

The metal loading can be any suitable amount, but is generally no more than about 2.5%, wherein the loading is expressed as the amount of metal by weight of the zeolite. In different embodiments, the metal loading is precisely, at least, less than, or up to, for example, 0.01%, 0.02%, 0.03%, 0.04%, 0.05%, 0.06%, 0.07%, 0.08%, 0.09%, 1.0%, 1.1%, 1.2%, 1.3%, 1.4%, 1.5%, 1.6%, 1.7%, 1.8%, 1.9%, 2.0%, 2.1%, 2.2%, 2.3%, 2.4%, or 2.5%, or a metal loading within a range bounded by any two of the foregoing values.

In further aspects of the invention, the zeolite catalyst may include at least one trivalent metal ion in addition to one or more metals described above. As used herein, the term "trivalent metal ion" is defined as a trivalent metal ion other than aluminum ($Al^{+3}$). Without wishing to be bound by any theory, it is believed that the trivalent metal is incorporated into the zeolite structure. More specifically, the incorporated trivalent metal ion is believed to be bound in the zeolite to an appropriate number of oxygen atoms, i.e., as a metal oxide unit containing the metal cation connected to the structure via oxygen bridges. In some embodiments, the presence of a trivalent metal ion in combination with one or more other catalytically active metal ions may provide a combined effect different than the cumulative effect of these ions when used alone. The effect primarily considered herein is on the resulting catalyst's ability to convert alcohols into hydrocarbons.

In some embodiments, only one type of trivalent metal ion aside from aluminum is incorporated into the zeolite. In other embodiments, at least two types of trivalent metal ions aside from aluminum are incorporated into the zeolite. In yet other embodiments, at least three types of trivalent metal ions aside from aluminum are incorporated into the zeolite. In yet other embodiments, precisely two or three types of trivalent metal ions aside from aluminum are incorporated into the zeolite.

Each of the trivalent metal ions can be included in any suitable amount, such as, precisely, at least, less than, or up to, for example, 0.01%, 0.02%, 0.03%, 0.04%, 0.05%, 0.06%, 0.07%, 0.08%, 0.09%, 1.0%, 1.1%, 1.2%, 1.3%, 1.4%, 1.5%, 1.6%, 1.7%, 1.8%, 1.9%, 2.0%, 2.1%, 2.2%, 2.3%, 2.4%, or 2.5%, or an amount within a range bounded by any two of the foregoing values. Alternatively, the total amount of trivalent metal ions (other than Al) may be limited to any of the foregoing values. In some embodiments, one or more specific types, or all, trivalent metal ions other than Al are excluded from the catalyst.

In a first set of embodiments, at least one trivalent metal ion is selected from trivalent transition metal ions. The one or more transition metals can be selected from any or a select portion of the following types of transition metals: elements of Groups IIIB (Sc group), IVB (Ti group), VB (V group), VIB (Cr group), VIIB (Mn group), VIIIB (Fe and Co groups) of the Periodic Table of the Elements. Some examples of trivalent transition metal ions include $Sc^{+3}$, $Y^{+3}$, $V^{+3}$, $Nb^{+3}$, $Cr^{+3}$, $Fe^{+3}$, and $Co^{+3}$. In particular embodiments, the trivalent transition metal ions include $Sc^{+3}$, or $Fe^{+3}$, or a combination thereof. In other embodiments, the trivalent metal ion excludes all transition metal ions, or alternatively, excludes any one, two, or more classes or specific examples of transition metal ions provided above.

In a second set of embodiments, at least one trivalent metal ion is selected from trivalent main group metal ions. The one or more main group metals can be selected from any or a select portion of elements of Group IIIA (B group) and/or Group VA (N group) of the Periodic Table, other than aluminum. Some examples of trivalent main group metal ions include $Ga^{+3}$, $In^{+3}$ $As^{+3}$, $Sb^{+3}$, and $Bi^{+3}$. In particular embodiments, the trivalent main group metal ions include at least $In^{3+}$. In other embodiments, the trivalent metal ion excludes all main group metal ions other than aluminum, or alternatively, excludes any one, two, or more classes or specific examples of main group metal ions provided above.

In a third set of embodiments, at least one trivalent metal ion is selected from trivalent lanthanide metal ions. Some examples of trivalent lanthanide metal ions considered herein include $La^{+3}$, $Ce^{+3}$, $Pr^{+3}$, $Nd^{+3}$, $Sm^{+3}$, $Eu^{+3}$, $Gd^{+3}$, $Tb^{+3}$, $Dy^{+3}$, $Ho^{+3}$, $Er^{+3}$, $Tm^{+3}$, $Yb^{+3}$, and $Lu^{+3}$. In particular embodiments, the trivalent lanthanide metal ion is selected from one or a combination of $La^{+3}$, $Ce^{+3}$, $Pr^{+3}$, and $Nd^{+3}$. In further particular embodiments, the trivalent lanthanide metal ion is or includes $La^{+3}$. In other embodiments, the trivalent metal ion excludes all lanthanide metal ions, or alternatively, excludes any one, two, or more classes or specific examples of lanthanide metal ions provided above.

In a fourth set of embodiments, the catalyst includes at least two trivalent metal ions selected from trivalent transition metal ions. Some combinations of trivalent transition metal ions considered herein include $Sc^{+3}$ in combination with one or more other trivalent transition metal ions, or $Fe^{+3}$ in combination with one or more other trivalent transition metal ions, or $Y^{+3}$ in combination with one or more other trivalent transition metal ions, or $V^{+3}$ in combination with one or more other trivalent transition metal ions.

In a fifth set of embodiments, the catalyst includes at least two trivalent metal ions selected from trivalent main group metal ions. Some combinations of trivalent main group metal ions considered herein include $In^{+3}$ in combination with one or more other trivalent main group metal ions, or $Ga^{+3}$ in combination with one or more other trivalent main group metal ions, or $As^{+3}$ in combination with one or more other trivalent main group metal ions.

In a sixth set of embodiments, the catalyst includes at least two trivalent metal ions selected from trivalent lanthanide metal ions. Some combinations of trivalent lanthanide metal ions considered herein include $La^{+3}$ in combination with one or more other trivalent lanthanide metal ions, or $Ce^{+3}$ in combination with one or more other trivalent lanthanide metal ions, or $Pr^{+3}$ in combination with one or more other trivalent lanthanide metal ions, or $Nd^{+3}$ in combination with one or more other trivalent lanthanide metal ions.

In a seventh set of embodiments, the catalyst includes at least one trivalent transition metal ion and at least one trivalent lanthanide metal ion. For example, in particular embodiments, at least one trivalent metal ion is selected from $Sc^{+3}$, $Fe^{+3}$, $V^{+3}$, and/or $Y^{+3}$, and another trivalent metal ion is selected from $La^{+3}$, $Ce^{+3}$, $Pr^{+3}$, and/or $Nd^{+3}$.

In an eighth set of embodiments, the catalyst includes at least one trivalent transition metal ion and at least one trivalent main group metal ion. For example, in particular embodiments, at least one trivalent metal ion is selected from $Sc^{+3}$, $Fe^{+3}$, $V^{+3}$, and/or $Y^{+3}$, and another trivalent metal ion is selected from $In^{+3}$, $Ga^{+3}$, and/or $In^{+3}$.

In a ninth set of embodiments, the catalyst includes at least one trivalent main group metal ion and at least one trivalent lanthanide metal ion. For example, in particular embodiments, at least one trivalent metal ion is selected from $In^{+3}$, $Ga^{+3}$, and/or $In^{+3}$, and another trivalent metal ion is selected from $La^{+3}$, $Ce^{+3}$, $Pr^{+3}$, and/or $Nd^{+3}$.

In a tenth set of embodiments, the catalyst includes at least three trivalent metal ions. The at least three trivalent metal ions can be selected from trivalent transition metal ions, trivalent main group metal ions, and/or trivalent lanthanide metal ions.

In particular embodiments, one, two, three, or more trivalent metal ions are selected from $Sc^{+3}$, $Fe^{+3}$, $V^{+3}$, $Y^{+3}$, $La^{+3}$, $Ce^{+3}$, $Pr^{+3}$, $Nd^{+3}$, $In^{+3}$, and/or $Ga^{+3}$. In more particular embodiments, one, two, three, or more trivalent metal ions are selected from $Sc^{+3}$, $Fe^{+3}$, $V^{+3}$, $La^{+3}$, and/or $In^{+3}$.

The zeolite catalyst described above is typically not coated with a metal-containing film or layer. However, the instant invention also contemplates the zeolite catalyst described above coated with a metal-containing film or layer as long as the film or layer does not substantially impede the catalyst from effectively functioning as a conversion catalyst, as intended herein. By being coated, the film or layer resides on the surface of the zeolite. In some embodiments, the surface of the zeolite refers to only the outer surface (i.e., as defined by the outer contour area of the zeolite catalyst), while in other embodiments, the surface of the zeolite refers to or includes inner surfaces of the zeolite, such as the surfaces within pores or channels of the zeolite. The metal-containing film or layer can serve, for example, to adjust the physical characteristics of the catalyst, the catalytic efficiency, or catalytic selectivity. Some examples of metal-containing surfaces include the oxides and/or sulfides of the alkali metals, alkaline earth metals, and divalent transition or main group metals, provided that such surface metals are non-contaminating to the hydrocarbon product and non-deleterious to the conversion process.

The catalyst described herein can be synthesized by any suitable method known in the art. The method considered herein should preferably incorporate the metal ions homogeneously into the zeolite. The zeolite may be a single type of zeolite, or a combination of different zeolite materials.

In particular embodiments, the catalyst described herein is prepared by, first, impregnating the zeolite with the metals to be loaded. The impregnating step can be achieved by, for example, treating the zeolite with one or more solutions containing salts of the metals to be loaded. By treating the zeolite with the metal-containing solution, the metal-containing solution is contacted with the zeolite such that the solution is absorbed into the zeolite, preferably into the entire volume of the zeolite. Typically, in preparing the metal-loaded zeolite catalyst (for example, copper-loaded or vanadium-loaded ZSM-5, i.e., "Cu-ZSM-5" or "V-ZSM-5", respectively), the acid zeolite form (i.e., H-ZSM5) or its ammonium salt (e.g., $NH_4$-ZSM-5) is used as a starting material on which an exchange with metal ions (e.g., copper or vanadium ions) is performed. The particulars of such metal exchange processes are well known in the art.

In one embodiment, the impregnating step is achieved by treating the zeolite with a solution that contains all of the metals to be loaded. In another embodiment, the impregnating step is achieved by treating the zeolite with two or more solutions, wherein the different solutions contain different metals or combinations of metals. Each treatment of the zeolite with an impregnating solution corresponds to a separate impregnating step. Typically, when more than one impregnating step is employed, a drying and/or thermal treatment step is employed between the impregnating steps.

The metal-impregnating solution contains at least one or more metal ions to be loaded into the zeolite, as well as a liquid carrier for distributing the metal ions into the zeolite. The metal ions are generally in the form of metal salts. Preferably, the metal salts are completely dissolved in the liquid carrier. The metal salt contains one or more metal ions in ionic association with one or more counteranions. Any one or more of the metal ions described above can serve as the metal ion portion. The counteranion can be selected from, for example, halides ($F^-$, $Cl^-$, $Br^-$, or F), carboxylates (e.g., formate, acetate, propionate, or butyrate), sulfate, nitrate, phosphate, chlorate, bromate, iodate, hydroxide, β-diketonate (e.g., acetylacetonate), and dicarboxylates (e.g., oxalate, malonate, or succinate).

In particular embodiments, the catalyst is prepared by forming a slurry containing zeolite powder and the metals to be incorporated. The resulting slurry is dried and fired to form a powder. The powder is then combined with organic and/or inorganic binders and wet-mixed to form a paste. The resulting paste can be formed into any desired shape, e.g., by extrusion into rod, honeycomb, or pinwheel structures. The extruded structures are then dried and fired to form the final catalyst. In other embodiments, the zeolite powder, metals, and binders are all combined together to form a paste, which is then extruded and fired.

After impregnating the zeolite, the metal-loaded zeolite is typically dried and/or subjected to a thermal treatment step (e.g., a firing or calcination step). The thermal treatment step functions to permanently incorporate the impregnated metals into the zeolite, e.g., by replacing $Al^{+3}$ and/or $Si^{+4}$ and forming metal-oxide bonds within the zeolite material. In different embodiments, the thermal treatment step can be conducted at a temperature of at least 100° C., 150° C., 200° C., 250° C., 300° C., 350° C., 400° C., 450° C., 500° C., 550° C., 600° C., 650° C., 700° C., 750° C., or 800° C., or within a range therein, for a time period of, for example, 15 minutes, 30 minutes, 1 hour, 2 hours, 6 hours, 12 hours, 24 hours, 30 hours, 36 hours, or 48 hours, or within a range therein. In some particular embodiments, the thermal treatment step is conducted at a temperature of at least 500° C. for a time period of at least two hours. In some embodiments, the thermal treatment step includes a temperature ramping step from a lower temperature to a higher temperature, and/or from a higher temperature to a lower temperature. For example, the thermal treatment step can include a ramp stage from 100-700° C., or vice-versa, at a rate of 1, 2, 5, or 10° C./min.

Generally, the one or more heat treatment steps for producing the metal-loaded zeolite catalyst are conducted under normal atmospheric pressure. However, in some embodiments, an elevated pressure (e.g., above 1 atm and up to 2, 5, or 10 atm) is employed, while in other embodiments, a reduced pressure (e.g., below 1, 0.5, or 0.2 atm) is employed. Furthermore, although the heat treatment steps are generally conducted under a normal air atmosphere, in some embodiments, an elevated oxygen, reduced oxygen, or inert atmosphere is used. Some gases that can be included in the processing atmosphere include, for example, oxygen, nitrogen, helium, argon, carbon dioxide, and mixtures thereof.

For the sake of providing a more descriptive example, a Cu-ZSM-5 catalyst can be prepared as follows: 2.664 g of copper acetate hydrate (i.e., $Cu(OAc)_2.6H_2O$) is dissolved in 600 mL de-ionized water (0.015M), followed by addition of 10.005 g of H-ZSM-5 zeolite. The slurry is kept stifling for about two hours at 50° C. Cu-ZSM-5 (blue in color) is collected by filtration after cooling, washed with de-ionized water, and calcined in air at about 500° C. (10° C./min) for four hours.

The produced Cu-ZSM-5 precursor can then be further impregnated with another metal, such as iron. For example, Cu—Fe-ZSM-5 can be produced as follows: 5 g of Cu-ZSM-5 is suspended in an aqueous solution of 25 mL of 0.015M $Fe(NO_3)_3$, degassed with $N_2$, and is kept stirring for about two hours at about 80° C. Brown solid is obtained after filtration, leaving a clear and colorless filtrate. The product is then calcined in air at about 500° C. (2° C./min) for about two hours. The resulting Cu—Fe-ZSM-5 catalyst typically contains about 2.4% Cu and 0.3% Fe. Numerous other metals can be loaded into the zeolite by similar means to produce a variety of different metal-loaded catalysts.

Generally, the zeolite catalyst described herein is in the form of a powder. In a first set of embodiments, at least a portion, or all, of the particles of the powder have a size less than a micron (i.e., nanosized particles). The nanosized particles can have a particle size of precisely, at least, up to, or less than, for example, 1, 2, 5, 10, 20, 30, 40, 50, 60, 70, 80, 90, 100, 150, 200, 250, 300, 350, 400, 450, 500, 550, 600, 650, 700, 750, 800, 850, 900, or 950 nanometers (nm), or a particle size within a range bounded by any two of the foregoing values. In a second set of embodiments, at least a portion, or all, of the particles of the powder have a size at or above 1 micron in size. The micron-sized particles can have a particle size of precisely, at least, up to, or less than, for example, 1, 2, 5, 10, 20, 30, 40, 50, 60, 70, 80, 90, or 100 microns (μm), or a particle size within a range bounded by any two of the foregoing values. In some embodiments, single crystals or grains of the catalyst correspond to any of the sizes provided above, while in other embodiments, crystals or grains of the catalyst are agglomerated to provide agglomerated crystallites or grains having any of the above exemplary dimensions.

In other embodiments, the zeolite catalyst can be in the form of a film, a coating, or a multiplicity of films or coatings. The thickness of the coatings or multiplicity of coatings can be, for example, 1, 2, 5, 10, 50, or 100 microns, or a range therein, or up to 100 micron thickness. In yet other embodiments, the zeolite catalyst is in the form of a nonparticulate (i.e., continuous) bulk solid. In still other embodiments, the zeolite catalyst can be fibrous or in the form of a mesh.

The catalyst can also be mixed with or affixed onto a support material suitable for operation in a catalytic converter. The support material can be a powder (e.g., having any of the above particle sizes), granular (e.g., 0.5 mm or greater particle size), a bulk material, such as a honeycomb monolith of the flow-through type, a plate or multi-plate structure, or corrugated metal sheets. If a honeycomb structure is used, the honeycomb structure can contain any suitable density of cells. For example, the honeycomb structure can have 100, 200, 300, 400, 500, 600, 700, 800, or 900 cells per square inch (cells/in$^2$) (or from 62-140 cells/cm$^2$) or greater. The support material is generally constructed of a refractory composition, such as those containing cordierite, mullite, alumina (e.g., α-, β-, or γ-alumina), or zirconia, or a combination thereof. Honeycomb structures, in particular, are described in detail in, for example, U.S. Pat. Nos. 5,314,665, 7,442,425, and 7,438,868, the contents of which are incorporated herein by reference in their entirety. When corrugated or other types of metal sheets are used, these can be layered on top of each other with catalyst material supported on the sheets such that passages remain that allow the flow of alcohol-containing fluid. The layered sheets can also be formed into a structure, such as a cylinder, by winding the sheets.

In particular embodiments, the zeolite catalyst is or includes a pentasil-type composition loaded with any of the suitable metals described above. In more specific embodiments, the zeolite catalyst is, or includes, for example, copper-loaded ZSM5 (i.e., Cu-ZSM5), Fe-ZSM5, Cu,Fe-ZSM5, or a mixture of Cu-ZSM5 and Fe-ZSM5. In other embodiments, the zeolite catalyst is, or includes, for example, Cu—La-ZSM5, Fe—La-ZSM5, Fe—Cu—La-ZSM5, Cu—Sc-ZSM5, or Cu—In-ZSM5.

Examples have been set forth below for the purpose of illustration and to describe certain specific embodiments of the invention. However, the scope of this invention is not to be in any way limited by the examples set forth herein.

EXAMPLES

A catalytic reactor was loaded with 0.2 g of V-ZSM-5 powder and heated to 500° C. for four hours under a flow of dry helium. The catalyst was cooled to 200° C., and pure methanol, ethanol, 1-propanol, 2-propanol, 1-butanol, 2-butanol, n-pentanol, 1-hexanol, 1-heptanol, or 1-octanol was introduced into the reactor employing a syringe pump at 1.0 mL/hour. Methanol and ethanol were run for comparison purposes only. The post-catalyst emissions were analyzed by on-line gas chromatography, and the data presented in Tables 1-11 below. In particular, the results show that a reaction temperature of 350° C. is suitable for diminishing CO to a negligible level, which suggests a minimal level of product decomposition on the catalyst surface.

The hydrocarbon distributions found in hydrocarbon blendstocks produced from various alcohols (i.e., methanol, ethanol, 1-propanol, 2-propanol, 1-butanol, 2-butanol, n-pentanol, 1-hexanol, 1-heptanol, and 1-octanol) are provided in Table 1 below:

TABLE 1

Hydrocarbon distribution in blendstocks produced from different alcohols varying in carbon number

| C | Methanol | Ethanol | 1-Propanol | 2-Propanol | 1-Butanol | 2-Butanol | n-Pentanol | 1-Hexanol | 1-Heptanol | 1-Octanol |
|---|---|---|---|---|---|---|---|---|---|---|
| 2 | 1.17 | 4.15 | 0.22 | 0.22 | 0.25 | 0.17 | 0.20 | 0.28 | 0.17 | 0.17 |
| 3 | 4.30 | 9.76 | 3.85 | 7.14 | 4.79 | 6.99 | 3.97 | 4.70 | 5.29 | 3.63 |
| 4 | 6.78 | 23.96 | 10.80 | 16.38 | 13.83 | 17.07 | 12.07 | 12.64 | 15.36 | 12.77 |
| 5 | 5.59 | 12.14 | 7.51 | 11.73 | 9.52 | 15.30 | 10.22 | 7.52 | 11.03 | 11.77 |
| 6 | 5.46 | 6.83 | 5.03 | 6.79 | 6.04 | 9.32 | 6.22 | 5.72 | 7.00 | 7.53 |
| 7 | 5.42 | 11.90 | 9.85 | 11.22 | 11.66 | 11.26 | 10.78 | 12.64 | 12.74 | 10.24 |
| 8 | 20.56 | 16.82 | 22.82 | 19.05 | 23.96 | 17.19 | 22.42 | 25.86 | 16.92 | 20.91 |
| 9 | 26.55 | 13.03 | 21.94 | 15.39 | 19.38 | 14.83 | 20.35 | 19.79 | 15.35 | 16.26 |
| 10 | 20.26 | 1.42 | 9.13 | 6.77 | 7.33 | 7.50 | 9.00 | 7.35 | 8.79 | 8.21 |
| 11 | 2.65 | 0.00 | 8.84 | 5.31 | 3.24 | 0.00 | 4.77 | 3.50 | 4.12 | 0.47 |
| 12 | 0.00 | 0.00 | 0.00 | 0.00 | 0.00 | 0.00 | 0.00 | 0.00 | 3.22 | 0.00 |
| 13 | 0.00 | 0.00 | 0.00 | 0.00 | 0.00 | 0.00 | 0.00 | 0.00 | 0.00 | 8.04 |

Detailed compositional distributions for hydrocarbon blendstocks produced by the various alcohols are provided in Tables 2-11 provided below:

TABLE 2

Hydrocarbon product distribution resulting from catalytic conversion of ethanol 1 ml/hr EtOH LHSV 2.93 h$^{-1}$ fresh V-ZSM5

| Peak # | Ret Time | Area | ID | % | |
|---|---|---|---|---|---|
| 1 | 2.261 | 99929362 | ethylene | 3.93 C2 | 4.15 |
| 2 | 2.724 | 5496728 | ethane | 0.22 C2 | |
| 3 | 6.336 | 129830986 | propene | 5.11 C3 | 9.76 |
| 4 | 6.631 | 118239284 | propane | 4.65 C3 | |
| 5 | 9.443 | 324290840 | isobutane | 12.76 C4 | 23.96 |
| 6 | 9.719 | 130200176 | 2-methyl-1-propene | 5.12 C4 | |
| 7 | 10.034 | 51345640 | butane | 2.02 C4 | |
| 8 | 10.064 | 69690241 | 2-butene | 2.74 C4 | |

TABLE 2-continued

Hydrocarbon product distribution resulting from catalytic conversion of ethanol
1 ml/hr EtOH LHSV 2.93 $h^{-1}$ fresh V-ZSM5

| | | | | | | |
|---|---|---|---|---|---|---|
| 9 | 10.208 | 33499932 | 2-butene | 1.32 | C4 | |
| 10 | 12.272 | 151141384 | 2-methylbutane | 5.95 | C5 | 12.14 |
| 11 | 12.406 | 35241866 | 2-methyl-2-butene | 1.39 | C5 | |
| 12 | 12.568 | 15580023 | cis-1,2-dimethylCyclopropane | 0.61 | C5 | |
| 13 | 12.665 | 100134896 | cis-1,2-dimethylCyclopropane | 3.94 | C5 | |
| 14 | 12.988 | 6467475 | 4-ethenyl-1,2-dimethyl-benzene | 0.25 | C5 | |
| 15 | 14.439 | 50978121 | 2-methylpentane | 2.01 | C6 | 6.83 |
| 16 | 14.586 | 18528086 | 3-methylpentane | 0.73 | C6 | |
| 17 | 14.628 | 15589528 | 3-methyl-3-pentene | 0.61 | C6 | |
| 18 | 14.804 | 61570970 | methylcyclopentane | 2.42 | C6 | |
| 19 | 15.166 | 27006303 | benzene | 1.06 | C6 | |
| 20 | 16.252 | 20980696 | 1,5-Dimethylcyclopentene | 0.83 | C7 | 11.90 |
| 21 | 16.346 | 24694733 | 1,2-Dimethylcyclopentane | 0.97 | C7 | |
| 22 | 16.424 | 19857803 | 4-ethenyl-1,2-dimethyl-Benzene | 0.78 | C10 | 1.42 |
| 23 | 16.664 | 18202042 | 4,4-Dimethylcyclopentene | 0.72 | C7 | |
| 24 | 16.923 | 16348889 | 1-Phenyl-1-butene | 0.64 | C10 | |
| 25 | 17.258 | 238620734 | toluene | 9.39 | C7 | |
| 26 | 19.613 | 72628015 | ethylbenzene | 2.86 | C8 | 16.82 |
| 27 | 19.746 | 285387414 | 1,3-dimethylbenzene | 11.23 | C8 | |
| 28 | 20.292 | 69507805 | p-xylene | 2.73 | C8 | |
| 29 | 23.165 | 166197903 | 1-ethyl-4-methylbenzene | 6.54 | C9 | 13.03 |
| 30 | 23.389 | 114374885 | 1-ethyl-2-methylbenzene | 4.50 | C9 | |
| 31 | 24.430 | 50728460 | 1,2,4-trimethylbenzene | 2.00 | C9 | |
| | total | 2542291220 | | | | |
| | % fuel | 95.85 | | | | |

| | | |
|---|---|---|
| C2+ | Aromatic | 41.72 |
| | Olefins | 18.80 |
| | Paraffins | 9.09 |
| | i-paraffins | 25.99 |
| | Naphthalenes | 0.00 |

TABLE 3

Hydrocarbon product distribution resulting from catalytic conversion of isobutanol
Isobutanol 1.0 ml/hr fresh V-ZSM5

| Peak # | Ret Time | Area | ID | % | | |
|---|---|---|---|---|---|---|
| 1 | 1.314 | 2540508 | N2 | | | |
| 2 | 2.274 | 4692123 | ethylene | 0.17 | C2 | 0.17 |
| 3 | 5.830 | 559297124 | H2O | | | |
| 4 | 6.314 | 158907450 | propene | 5.86 | C3 | 6.99 |
| 5 | 6.610 | 30761820 | propane | 1.13 | C3 | |
| 6 | 9.466 | 110114626 | isobutane | 4.06 | C4 | 17.07 |
| 7 | 9.722 | 201912349 | 2-methyl-1-propene | 7.44 | C4 | |
| 8 | 10.076 | 101653877 | (E)-2-Butene | 3.75 | C4 | |
| 9 | 10.221 | 49567571 | (E)-2-Butene | 1.83 | C4 | |
| 10 | 11.950 | 6853410 | 2-Methyl-1-butene | 0.25 | C5 | 15.30 |
| 11 | 12.150 | 9534788 | Acetone | 0.35 | | |
| 12 | 12.288 | 74860884 | 2-methylbutane | 2.76 | C5 | |
| 13 | 12.416 | 73929701 | 2-methyl-2-butene | 2.72 | C5 | |
| 14 | 12.577 | 39343224 | (E)-2-Pentene | 1.45 | C5 | |
| 15 | 12.670 | 220216552 | 2-methyl-2-butene | 8.12 | C5 | |
| 16 | 14.257 | 20687916 | (Z)-4-Methyl-2-pentene | 0.76 | C6 | 9.32 |
| 17 | 14.458 | 43497772 | 2-methylpentane | 1.60 | C6 | |
| 18 | 14.559 | 15385936 | 2-Methyl-1-pentene | 0.57 | C6 | |
| 19 | 14.647 | 53768192 | (E)-3-Methyl-2-pentene | 1.98 | C6 | |
| 20 | 14.725 | 27793873 | 3-methylene-Pentane | 1.02 | C6 | |
| 21 | 14.810 | 43169806 | (E)-3-Methyl-2-pentene | 1.59 | C6 | |
| 22 | 14.863 | 48611348 | 2,4-Hexadiene | 1.79 | C6 | |
| 23 | 15.894 | 5922368 | (E)-4,4-Dimethyl-2-pentene | 0.22 | C7 | 11.26 |
| 24 | 16.163 | 6187063 | (Z)-3-Methyl-2-hexene | 0.23 | C7 | |
| 25 | 16.259 | 37724570 | 4,4-Dimethylcyclopentene | 1.39 | C7 | |
| 26 | 16.367 | 29705705 | 2-Methylhexane | 1.09 | C7 | |
| 27 | 16.442 | 37388672 | 3-Methylhexane | 1.38 | C7 | |
| 28 | 16.514 | 27646209 | 3-Methyl-3-hexene | 1.02 | C7 | |
| 29 | 16.684 | 53044824 | 4,4-Dimethylcyclopentene | 1.96 | C7 | |
| 30 | 16.944 | 15704856 | Cycloheptane | 0.58 | C7 | |
| 31 | 17.205 | 15042326 | 1-Methylcyclohexene | 0.55 | C7 | |
| 32 | 17.282 | 77197844 | Toluene | 2.85 | C7 | |
| 33 | 18.028 | 22675409 | 2,5-Dimethyl-2,4-hexadiene | 0.84 | C8 | 17.19 |
| 34 | 18.262 | 29368151 | 1,2,3-Trimethylcyclopentene | 1.08 | C8 | |

TABLE 3-continued

Hydrocarbon product distribution resulting from catalytic conversion of isobutanol
Isobutanol 1.0 ml/hr fresh V-ZSM5

| | | | | | |
|---|---|---|---|---|---|
| 35 | 18.393 | 16737579 | 2,5-dimethyl-Hexane | 0.62 C8 | |
| 36 | 18.469 | 16634463 | | 0.61 | |
| 37 | 18.626 | 19975485 | 1,2-Dimethylcyclohexene | 0.74 C8 | |
| 38 | 19.058 | 21540845 | 1,4-Dimethyl-1-cyclohexene | 0.79 C8 | |
| 39 | 19.642 | 41030284 | Ethylbenzene | 1.51 C8 | |
| 40 | 19.783 | 274188758 | o-Xylene | 10.11 C8 | |
| 41 | 20.326 | 24311822 | p-Xylene | 0.90 C8 | |
| 42 | 23.165 | 145434254 | 1-Ethyl-3-methylbenzene | 5.36 C9 | 14.83 |
| 43 | 23.381 | 180443866 | 1-Ethyl-4-methylbenzene | 6.65 C9 | |
| 44 | 24.408 | 76435352 | 1,3,5-Trimethylbenzene | 2.82 C9 | |
| 45 | 28.620 | 36889320 | 1,2-Diethylbenzene | 1.36 C10 | 7.50 |
| 46 | 28.999 | 45891003 | 1-Methyl-4-propylbenzene | 1.69 C10 | |
| 47 | 29.439 | 83204150 | 1,3-Diethylbenzene | 3.07 C10 | |
| 48 | 30.794 | 37586404 | 1-ethyl-2,3-dimethylBenzene | 1.39 C10 | |
| | total | 2713174800 | | | |
| | % fuel | 99.48 | | | |
| | C2+ | | Aromatic | 37.69 | |
| | | | Olefins | 46.92 | |
| | | | Paraffins | 1.71 | |
| | | | i-paraffins | 12.54 | |
| | | | Naphthalenes | 0.00 | |

TABLE 4

Hydrocarbon product distribution resulting from catalytic conversion of isopropanol
V-ZSM5 Isopropanol 1.0 ml/hr fresh V-ZSM5

| Peak # | Ret Time | Area | ID | % | |
|---|---|---|---|---|---|
| 1 | 1.315 | 1865227 | N2 | | |
| 2 | 2.277 | 11295030 | ethylene | 0.22 C2 | 0.22 |
| 3 | 6.353 | 284807891 | Propene | 5.44 C3 | 7.14 |
| 4 | 6.660 | 88859654 | Propane | 1.70 C3 | |
| 5 | 9.468 | 277841074 | Isobutane | 5.31 C4 | 16.38 |
| 6 | 9.733 | 292402610 | 2-Methyl-1-propene | 5.58 C4 | |
| 7 | 10.081 | 200805895 | (E)-2-Butene | 3.84 C4 | |
| 8 | 10.225 | 86404741 | (E)-2-Butene | 1.65 C4 | |
| 9 | 11.954 | 9006210 | 2-Methyl-1-butene | 0.17 C5 | 11.73 |
| 10 | 12.293 | 168781936 | 2-Methylbutane | 3.22 C5 | |
| 11 | 12.423 | 98284664 | 2-methyl-2-butene | 1.88 C5 | |
| 12 | 12.585 | 50297074 | cis-1,2-dimethylCyclopropane | 0.96 C5 | |
| 13 | 12.681 | 287791280 | 2-methyl-2-butene | 5.50 C5 | |
| 14 | 14.260 | 22420197 | (Z)-4-Methyl-2-pentene | 0.43 C6 | 6.79 |
| 15 | 14.463 | 73311992 | 2-Methylpentane | 1.40 C6 | |
| 16 | 14.652 | 86982993 | (E)-3-Methyl-2-pentene | 1.66 C6 | |
| 17 | 14.728 | 29361909 | (Z)-3-Methyl-2-pentene | 0.56 C6 | |
| 18 | 14.865 | 123566685 | 3,3-Dimethyl-1-cyclobutene | 2.36 C6 | |
| 19 | 15.184 | 19963266 | Benzene | 0.38 C6 | |
| 20 | 16.170 | 9075369 | 3-Methyl-2-hexene | 0.17 C7 | 11.22 |
| 21 | 16.265 | 42062489 | 3,5-Dimethylcyclopentene | 0.80 C7 | |
| 22 | 16.372 | 50656790 | 2-Methylhexane | 0.97 C7 | |
| 23 | 16.449 | 77531237 | 3-Methylhexane | 1.48 C7 | |
| 24 | 16.689 | 61007417 | 4,4-Dimethylcyclopentene | 1.17 C7 | |
| 25 | 16.950 | 25335024 | Cycloheptane | 0.48 C7 | |
| 26 | 17.280 | 321846799 | Toluene | 6.15 C7 | |
| 27 | 18.036 | 23840370 | 2,5-Dimethyl-2,4-hexadiene | 0.46 C8 | 19.05 |
| 28 | 18.268 | 30208676 | 1,2,3-Trimethylcyclopentene | 0.58 C8 | |
| 29 | 18.398 | 17715303 | 3,4-Dimethylstyrene | 0.34 C10 | |
| 30 | 18.477 | 16278464 | 1-Phenyl-1-butene | 0.31 C10 | |
| 31 | 18.632 | 29349655 | 1,2-Dimethyl-1-cyclooctene | 0.56 C8 | |
| 32 | 19.063 | 23491603 | 1,4-Dimethyl-1-cyclohexene | 0.45 C8 | |
| 33 | 19.647 | 108922698 | Ethylbenzene | 2.08 C8 | |
| 34 | 19.777 | 659965124 | 1,3-Dimethylbenzene | 12.60 C8 | |
| 35 | 20.330 | 121683074 | o-Xylene | 2.32 C8 | |
| 36 | 23.177 | 344326573 | 1-Ethyl-4-methylbenzene | 6.58 C9 | 15.39 |
| 37 | 23.401 | 270335380 | 1-Ethyl-4-methylbenzene | 5.16 C9 | |
| 38 | 23.887 | 29461270 | 1-Ethyl-3-methylbenzene | 0.56 C9 | |
| 39 | 24.426 | 161922912 | 1,3,5-Trimethylbenzene | 3.09 C9 | |
| 40 | 28.645 | 58050896 | 1,4-Diethylbenzene | 1.11 C10 | 6.77 |
| 41 | 29.031 | 59415638 | 1-Methyl-4-propylbenzene | 1.13 C10 | |
| 42 | 29.474 | 87523049 | 1,3-Diethylbenzene | 1.67 C10 | |

TABLE 4-continued

Hydrocarbon product distribution resulting from catalytic conversion of isopropanol
V-ZSM5 Isopropanol 1.0 ml/hr fresh V-ZSM5

| | | | | | | |
|---|---|---|---|---|---|---|
| 43 | 30.780 | 61042481 | 4-Ethyl-1,2-dimethylbenzene | 1.17 | C10 | |
| 44 | 33.670 | 54483429 | 2,5-Dimethylstyrene | 1.04 | C10 | |
| 45 | 41.962 | 237019659 | 1,2-Dimethylindane | 4.53 | C11 | 5.31 |
| 46 | 62.493 | 28816675 | Benzocycloheptatriene | 0.55 | C11 | |
| 47 | 62.590 | 12334525 | Benzocycloheptatriene | 0.24 | C11 | |
| | total | 5235887680 | | | | |
| | % fuel | 99.78 | | | | |
| | C2+ | | Aromatic | 51.02 | | |
| | | | Olefins | 33.56 | | |
| | | | Paraffins | 2.18 | | |
| | | | i-paraffins | 13.34 | | |
| | | | Naphthalenes | 0.00 | | |

TABLE 5

Hydrocarbon product distribution resulting from catalytic conversion of 1-propanol
V-ZSM5 1-propanol 1.0 ml/hr fresh V-ZSM5

| Peak # | Ret Time | Area | ID | % | | |
|---|---|---|---|---|---|---|
| 1 | 1.315 | 3125142 | N2 | | | |
| 2 | 2.275 | 17304136 | ethylene | 0.22 | C2 | 0.22 |
| 3 | 6.356 | 181085311 | Propene | 2.32 | C3 | 3.85 |
| 4 | 6.653 | 118998289 | Propane | 1.53 | C3 | |
| 5 | 9.462 | 397009252 | Isobutane | 5.09 | C4 | 10.80 |
| 6 | 9.736 | 201615562 | 2-Methyl-1-propene | 2.59 | C4 | |
| 7 | 10.080 | 190488824 | (E)-2-Butene | 2.44 | C4 | |
| 8 | 10.226 | 52586609 | (E)-2-Butene | 0.67 | C4 | |
| 9 | 12.288 | 263620042 | 2-Methylbutane | 3.38 | C5 | 7.51 |
| 10 | 12.423 | 67251414 | 2-Methyl-2-butene | 0.86 | C5 | |
| 11 | 12.586 | 29983786 | cis-1,2-Dimethylcyclopropane | 0.38 | C5 | |
| 12 | 12.680 | 224548579 | 2-Methyl-2-butene | 2.88 | C5 | |
| 13 | 14.260 | 11832906 | (Z)-4-Methyl-2-pentene | 0.15 | C6 | 5.03 |
| 14 | 14.460 | 129281220 | 2-Methylpentane | 1.66 | C6 | |
| 15 | 14.647 | 79083850 | (E)-3-Methyl-2-pentene | 1.01 | C6 | |
| 16 | 14.729 | 15611036 | (Z)-3-Methyl-2-pentene | 0.20 | C6 | |
| 17 | 14.827 | 131740181 | Methylcyclopentane | 1.69 | C6 | |
| 18 | 15.183 | 24170874 | Benzene | 0.31 | C6 | |
| 19 | 15.384 | 10235741 | 3,4-Dimethylstyrene | 0.13 | C10 | |
| 20 | 16.266 | 46325622 | 4,4-Dimethylcyclopentene | 0.59 | C7 | 9.85 |
| 21 | 16.370 | 84616179 | 2-Methylhexane | 1.09 | C7 | |
| 22 | 16.446 | 80475937 | 3-Methylhexane | 1.03 | C7 | |
| 23 | 16.690 | 70526800 | 4,4-Dimethylcyclopentene | 0.90 | C7 | |
| 24 | 16.947 | 37769140 | Cycloheptane | 0.48 | C7 | |
| 25 | 17.276 | 447929711 | Toluene | 5.75 | C7 | |
| 26 | 18.034 | 24166273 | 1,2,3-Trimethylcyclopentene | 0.31 | C8 | 22.82 |
| 27 | 18.264 | 41133379 | 1,2,3-Trimethylcyclopentene | 0.53 | C8 | |
| 28 | 18.399 | 30074870 | 2-Methylheptane | 0.39 | C8 | |
| 29 | 18.485 | 22800835 | 3-Ethylhexane | 0.29 | C8 | |
| 30 | 18.624 | 41008512 | trans-1-Ethyl-3-Methylcyclopentane | 0.53 | C8 | |
| 31 | 19.059 | 26103216 | 1,4-Dimethyl-1-cyclohexene | 0.33 | C8 | |
| 32 | 19.633 | 187506172 | Ethylbenzene | 2.41 | C8 | |
| 33 | 19.759 | 1235460116 | 1,3-Dimethylbenzene | 15.85 | C8 | |
| 34 | 20.320 | 170703061 | 1,3-Dimethylbenzene | 2.19 | C8 | |
| 35 | 23.135 | 794895255 | 1-Ethyl-4-methylbenzene | 10.20 | C9 | 21.94 |
| 36 | 23.363 | 570580090 | 1-Ethyl-4-methylbenzene | 7.32 | C9 | |
| 37 | 23.865 | 28212701 | 1-Ethyl-3-methylbenzene | 0.36 | C9 | |
| 38 | 24.393 | 316613928 | 1,3,5-Trimethylbenzene | 4.06 | C9 | |
| 39 | 28.559 | 161629987 | 1,3-Diethylbenzene | 2.07 | C10 | 9.13 |
| 40 | 28.942 | 152696773 | 1-Methyl-4-propylbenzene | 1.96 | C10 | |
| 41 | 29.391 | 171879965 | 1,3-Diethylbenzene | 2.21 | C10 | |
| 42 | 30.729 | 117917063 | 1-Ethyl-2,3-dimethylbenzene | 1.51 | C10 | |
| 43 | 33.574 | 97589295 | 5-Methylindane | 1.25 | C10 | |
| 44 | 41.858 | 689178379 | 1,2-Dimethylindane | 8.84 | C11 | 8.84 |
| | total | 7794240871 | | | | |
| | % fuel | 99.78 | | | | |

TABLE 5-continued

| Hydrocarbon product distribution resulting from catalytic conversion of 1-propanol V-ZSM5 1-propanol 1.0 ml/hr fresh V-ZSM5 | | |
|---|---|---|
| C2+ | Aromatic | 66.42 |
| | Olefins | 15.81 |
| | Paraffins | 3.70 |
| | i-paraffins | 13.46 |
| | Naphthalenes | 0.00 |

TABLE 6

Hydrocarbon product distribution resulting from catalytic conversion of 1-butanol V-ZSM5 1-butanol 1.0 ml/hr fresh V-ZSM5

| Peak # | Ret Time | Area | ID | % | |
|---|---|---|---|---|---|
| 1 | 1.315 | 3014692 | N2 | | |
| 2 | 2.277 | 16660014 | ethylene | 0.25 C2 | 0.25 |
| 3 | 6.359 | 203413515 | Propene | 3.03 C3 | 4.79 |
| 4 | 6.659 | 118271351 | Propane | 1.76 C3 | |
| 5 | 9.465 | 410087310 | Isobutane | 6.11 C4 | 13.83 |
| 6 | 9.738 | 233331010 | 2-Methyl-1-propene | 3.47 C4 | |
| 7 | 10.083 | 222688373 | (E)-2-Butene | 3.32 C4 | |
| 8 | 10.230 | 62852301 | (E)-2-Butene | 0.94 C4 | |
| 9 | 12.293 | 265224151 | 2-Methylbutane | 3.95 C5 | 9.52 |
| 10 | 12.427 | 81651223 | 2-Methyl-2-butene | 1.22 C5 | |
| 11 | 12.588 | 37637085 | cis-1,2-Dimethylcyclopropane | 0.56 C5 | |
| 12 | 12.684 | 254941080 | 2-Methyl-2-butene | 3.80 C5 | |
| 13 | 14.262 | 13919602 | (Z)-4-Methyl-2-pentene | 0.21 C6 | 6.04 |
| 14 | 14.463 | 117523057 | 2-Methylpentane | 1.75 C6 | |
| 15 | 14.652 | 84672350 | 3,3-Dimethyl-1-butene | 1.26 C6 | |
| 16 | 14.730 | 19474080 | 3-Methylenepentane | 0.29 C6 | |
| 17 | 14.829 | 139052587 | Methylcyclopentane | 2.07 C6 | |
| 18 | 15.186 | 30985719 | Benzene | 0.46 C6 | |
| 19 | 16.270 | 50795406 | 3,5-Dimethylcyclopentene | 0.76 C7 | 11.66 |
| 20 | 16.373 | 72164678 | 2-Methylhexane | 1.07 C7 | |
| 21 | 16.448 | 74467645 | 3-Methylhexane | 1.11 C7 | |
| 22 | 16.692 | 67535376 | 4,4-Dimethylcyclopentene | 1.01 C7 | |
| 23 | 16.949 | 35396832 | Cycloheptane | 0.53 C7 | |
| 24 | 17.276 | 482909837 | Toluene | 7.19 C7 | |
| 25 | 18.035 | 22627099 | 1,2,3-Trimethylcyclopentene | 0.34 C8 | 23.96 |
| 26 | 18.266 | 36159987 | 1,2,3-Trimethylcyclopentene | 0.54 C8 | |
| 27 | 18.402 | 27410841 | 2-Methylheptane | 0.41 C8 | |
| 28 | 18.488 | 22705195 | 3-Ethylhexane | 0.34 C8 | |
| 29 | 18.627 | 38254495 | trans-1-Ethyl-3-Methylcyclopentane | 0.57 C8 | |
| 30 | 19.060 | 26497992 | 1,4-Dimethyl-1-cyclohexene | 0.39 C8 | |
| 31 | 19.636 | 173965093 | Ethylbenzene | 2.59 C8 | |
| 32 | 19.760 | 1070615946 | o-Xylene | 15.94 C8 | |
| 33 | 20.321 | 190894931 | o-Xylene | 2.84 C8 | |
| 34 | 23.153 | 590271414 | 1-Ethyl-4-methylbenzene | 8.79 C9 | 19.38 |
| 35 | 23.375 | 416841528 | 1-Ethyl-4-methylbenzene | 6.21 C9 | |
| 36 | 23.869 | 37194152 | 1-Ethyl-3-methylbenzene | 0.55 C9 | |
| 37 | 24.410 | 257042228 | 1,3,5-Trimethylbenzene | 3.83 C9 | |
| 38 | 28.588 | 108824592 | 1,3-Diethylbenzene | 1.62 C10 | 7.33 |
| 39 | 28.982 | 87285693 | 1-Methyl-4-propylbenzene | 1.30 C10 | |
| 40 | 29.410 | 120104862 | 1,3-Diethylbenzene | 1.79 C10 | |
| 41 | 30.738 | 90506279 | 1-Ethyl-2,3-dimethylbenzene | 1.35 C10 | |
| 42 | 33.584 | 85301513 | 5-Methylindane | 1.27 C10 | |
| 43 | 41.883 | 115518224 | 1-Methyl-4-(1-methyl-2-propenyl)benzene | 1.72 C11 | 3.24 |
| 44 | 62.789 | 101802208 | Benzocycloheptatriene | 1.52 C11 | |
| | total | 6715478854 | | | |
| | % fuel | 99.75 | | | |

| | | |
|---|---|---|
| C2+ | Aromatic | 58.97 |
| | Olefins | 20.27 |
| | Paraffins | 4.36 |
| | i-paraffins | 15.03 |
| | Naphthalenes | 0.00 |

TABLE 7

Hydrocarbon product distribution resulting from catalytic conversion of methanol
V-ZSM5 Methanol 1.0 ml/hr fresh V-ZSM5

| Peak # | Ret Time | Area | ID | % | | |
|---|---|---|---|---|---|---|
| 1 | 1.315 | 3773719 | N2 | | | |
| 2 | 2.274 | 56376777 | ethylene | 1.17 | C2 | 1.17 |
| 3 | 6.365 | 129419213 | Propene | 2.68 | C3 | 4.30 |
| 4 | 6.661 | 78090343 | Propane | 1.62 | C3 | |
| 5 | 7.968 | 55299128 | Dimethyl ether | 1.14 | | |
| 6 | 9.018 | 38383487 | Methanol | | | |
| 7 | 9.473 | 169251064 | Isobutane | 3.50 | C4 | 6.78 |
| 8 | 9.744 | 62040641 | 2-Methyl-1-propene | 1.28 | C4 | |
| 9 | 10.085 | 73654585 | (E)-2-Butene | 1.52 | C4 | |
| 10 | 10.230 | 22359490 | (E)-2-Butene | 0.46 | C4 | |
| 11 | 12.162 | 5832992 | Acetone | 0.12 | | |
| 12 | 12.294 | 174708784 | 2-Methylbutane | 3.62 | C5 | 5.59 |
| 13 | 12.426 | 24981409 | 2-Methyl-2-butene | 0.52 | C5 | |
| 14 | 12.590 | 9377331 | cis-1,2-Dimethylcyclopropane | 0.19 | C5 | |
| 15 | 12.687 | 60899333 | cis-1,2-Dimethylcyclopropane | 1.26 | C5 | |
| 16 | 14.258 | 5117728 | (Z)-4-Methyl-2-pentene | 0.11 | C6 | 5.46 |
| 17 | 14.459 | 116754679 | 2-Methylpentane | 2.42 | C6 | |
| 18 | 14.608 | 83377958 | 3-Methylpentane | 1.73 | C6 | |
| 19 | 14.826 | 52254077 | Methylcyclopentane | 1.08 | C6 | |
| 20 | 15.184 | 6141636 | Benzene | 0.13 | C6 | |
| 21 | 16.276 | 18294215 | 1,5-Dimethylcyclopentene | 0.38 | C7 | 5.42 |
| 22 | 16.371 | 42872148 | 2-Methylhexane | 0.89 | C7 | |
| 23 | 16.450 | 45667998 | 3-Methylhexane | 0.95 | C7 | |
| 24 | 16.690 | 23459989 | 1,5-Dimethylcyclopentene | 0.49 | C7 | |
| 25 | 16.949 | 38853967 | Methylcyclohexane | 0.80 | C7 | |
| 26 | 17.285 | 92649484 | Toluene | 1.92 | C7 | |
| 27 | 18.036 | 10654190 | 1,2,3-Trimethylcyclopentene | 0.22 | C8 | 20.56 |
| 28 | 18.266 | 19213082 | 1,2,3-Trimethylcyclopentene | 0.40 | C8 | |
| 29 | 18.397 | 12058000 | 1-Phenyl-1-butene | 0.25 | C10 | |
| 30 | 18.623 | 31312293 | trans-1-Ethyl-3-Methylcyclopentane | 0.65 | C8 | |
| 31 | 19.645 | 32318371 | Ethylbenzene | 0.67 | C8 | |
| 32 | 19.774 | 778709632 | 1,3-dimethyl-Benzene | 16.12 | C8 | |
| 33 | 20.325 | 120871778 | o-Xylene | 2.50 | C8 | |
| 34 | 23.171 | 176785332 | 1-Ethyl-4-methylbenzene | 3.66 | C9 | 26.55 |
| 35 | 23.389 | 140557181 | 1-Ethyl-4-methylbenzene | 2.91 | C9 | |
| 36 | 24.350 | 964999159 | 1,2,3-Trimethylbenzene | 19.98 | C9 | |
| 37 | 28.568 | 22503552 | 1,4-Diethylbenzene | 0.47 | C10 | 20.26 |
| 38 | 28.957 | 25651693 | 1-Methyl-4-propylbenzene | 0.53 | C10 | |
| 39 | 29.413 | 26242130 | 1,4-Diethylbenzene | 0.54 | C10 | |
| 40 | 30.677 | 128116004 | 4-Ethyl-1,2-dimethylbenzene | 2.65 | C10 | |
| 41 | 32.654 | 764100085 | 1,2,4,5-Tetramethylbenzene | 15.82 | C10 | |
| 42 | 42.185 | 128138675 | 1,2-Dimethylindane | 2.65 | C11 | 2.65 |
| | total | 4829966126 | | | | |
| | % fuel | 97.57 | | | | |

| C2+ | | |
|---|---|---|
| | Aromatic | 70.56 |
| | Olefins | 8.31 |
| | Paraffins | 3.50 |
| | i-paraffins | 15.20 |
| | Naphthalenes | |

TABLE 8

Hydrocarbon product distribution resulting from catalytic conversion of n-pentanol
V-ZSM5 n-Pentanol 1.0 ml/hr fresh V-ZSM5

| Peak # | Ret Time | Area | ID | % | | |
|---|---|---|---|---|---|---|
| 1 | 1.315 | 2121043 | N2 | | | |
| 2 | 2.275 | 12683569 | ethylene | 0.20 | C2 | 0.20 |
| 3 | 6.354 | 167106441 | Propene | 2.66 | C3 | 3.97 |
| 4 | 6.655 | 82106482 | Propane | 1.31 | C3 | |
| 5 | 9.461 | 310805897 | Isobutane | 4.95 | C4 | 12.07 |
| 6 | 9.732 | 218539689 | 2-Methyl-1-propene | 3.48 | C4 | |
| 7 | 10.080 | 170495753 | (E)-2-Butene | 2.72 | C4 | |
| 8 | 10.226 | 57789880 | (E)-2-Butene | 0.92 | C4 | |
| 9 | 12.287 | 262282550 | 2-Methylbutane | 4.18 | C5 | 10.22 |
| 10 | 12.423 | 82813632 | 2-Methyl-2-butene | 1.32 | C5 | |
| 11 | 12.584 | 38222977 | cis-1,2-Dimethylcyclopropane | 0.61 | C5 | |
| 12 | 12.679 | 258385608 | 2-Methyl-2-butene | 4.12 | C5 | |
| 13 | 14.260 | 17501131 | (Z)-4-Methyl-2-pentene | 0.28 | C6 | 6.22 |

TABLE 8-continued

Hydrocarbon product distribution resulting from catalytic conversion of n-pentanol
V-ZSM5 n-Pentanol 1.0 ml/hr fresh V-ZSM5

| | | | | | | |
|---|---|---|---|---|---|---|
| 14 | 14.460 | 111914946 | 2-Methylpentane | 1.78 | C6 | |
| 15 | 14.650 | 85924326 | (E)-3-Methyl-2-pentene | 1.37 | C6 | |
| 16 | 14.728 | 22669228 | 3-Methylenepentane | 0.36 | C6 | |
| 17 | 14.825 | 133319879 | Cyclohexane | 2.12 | C6 | |
| 18 | 15.184 | 19054502 | Benzene | 0.30 | C6 | |
| 19 | 15.387 | 7494446 | 3,4-Dimethylstyrene | 0.12 | C10 | |
| 20 | 16.268 | 55324121 | 3,5-Dimethylcyclopentene | 0.88 | C7 | 10.78 |
| 21 | 16.371 | 64614064 | 2-Methylhexane | 1.03 | C7 | |
| 22 | 16.445 | 77278326 | 3-Methylhexane | 1.23 | C7 | |
| 23 | 16.690 | 75725654 | 1,5-Dimethylcyclopentene | 1.21 | C7 | |
| 24 | 16.866 | 8311714 | Ethylidenecyclopentane | 0.13 | C7 | |
| 25 | 16.948 | 32056508 | Cycloheptane | 0.51 | C7 | |
| 26 | 17.277 | 363327273 | Toluene | 5.79 | C7 | |
| 27 | 18.034 | 30194111 | 1,2,3-Trimethylcyclopentene | 0.48 | C8 | 22.42 |
| 28 | 18.265 | 46793135 | 1,2,3-Trimethylcyclopentene | 0.75 | C8 | |
| 29 | 18.400 | 26716425 | 2-Methylheptane | 0.43 | C8 | |
| 30 | 18.484 | 22361491 | 3-Ethylhexane | 0.36 | C8 | |
| 31 | 18.629 | 36905233 | 1-Methyl-2-methylenecyclohexane | 0.59 | C8 | |
| 32 | 19.061 | 26990281 | 1,4-Dimethyl-1-cyclohexene | 0.43 | C8 | |
| 33 | 19.635 | 142263071 | Ethylbenzene | 2.27 | C8 | |
| 34 | 19.761 | 928961476 | o-Xylene | 14.80 | C8 | |
| 35 | 20.322 | 146087057 | p-Xylene | 2.33 | C8 | |
| 36 | 23.136 | 540233767 | 1-Ethyl-4-methylbenzene | 8.61 | C9 | 20.35 |
| 37 | 23.359 | 456030936 | 1-Ethyl-4-methylbenzene | 7.26 | C9 | |
| 38 | 23.862 | 27966846 | 1-Ethyl-3-methylbenzene | 0.45 | C9 | |
| 39 | 24.388 | 253504187 | 1,3,5-Trimethylbenzene | 4.04 | C9 | |
| 40 | 28.526 | 107459033 | 1,3-Diethylbenzene | 1.71 | C10 | 9.00 |
| 41 | 28.919 | 107071886 | 1-Methyl-4-propylbenzene | 1.71 | C10 | |
| 42 | 29.344 | 154258228 | 1,3-Diethylbenzene | 2.46 | C10 | |
| 43 | 30.671 | 102653082 | 1-Isopropyl-3-methylbenzene | 1.64 | C10 | |
| 44 | 33.488 | 85976479 | 4-Methylindane | 1.37 | C10 | |
| 45 | 38.047 | 43661203 | 1-Methyl-3,5-diethylbenzene | 0.70 | C11 | 4.77 |
| 46 | 41.610 | 145529444 | 1-Methyl-4-(1-methyl-2-propenyl)benzene | 2.32 | C11 | |
| 47 | 61.997 | 87616280 | Benzocycloheptatriene | 1.40 | C11 | |
| 48 | 62.251 | 22937545 | Benzocycloheptatriene | 0.37 | C11 | |
| | Total | 6277919792 | | | | |
| | % fuel | 99.80 | | | | |

| | | |
|---|---|---|
| C2+ | Aromatic | 59.61 |
| | Olefins | 19.40 |
| | Paraffins | 4.96 |
| | i-paraffins | 15.51 |
| | Naphthalenes | 0.00 |

TABLE 9

Hydrocarbon product distribution resulting from catalytic conversion of 1-hexanol
V-ZSM5 1-hexanol 1.0 ml/hr fresh V-ZSM5

| Peak # | Ret Time | Area | ID | % | | |
|---|---|---|---|---|---|---|
| 1 | 2.276 | 18220777 | ethylene | 0.28 | C2 | 0.28 |
| 2 | 6.355 | 159997699 | Propene | 2.48 | C3 | 4.70 |
| 3 | 6.650 | 143494331 | Propane | 2.22 | C3 | |
| 4 | 9.459 | 435220551 | Isobutane | 6.75 | C4 | 12.64 |
| 5 | 9.738 | 153220259 | 2-Methyl-1-propene | 2.37 | C4 | |
| 6 | 10.050 | 96838493 | Butane | 1.50 | C4 | |
| 7 | 10.083 | 88717943 | (E)-2-Butene | 1.38 | C4 | |
| 8 | 10.229 | 41186627 | (E)-2-Butene | 0.64 | C4 | |
| 9 | 12.290 | 248979245 | 2-Methylbutane | 3.86 | C5 | 7.52 |
| 10 | 12.428 | 50423136 | 2-Methyl-2-butene | 0.78 | C5 | |
| 11 | 12.589 | 21517724 | cis-1,2-Dimethylcyclopropane | 0.33 | C5 | |
| 12 | 12.684 | 163980637 | cis-1,2-Dimethylcyclopropane | 2.54 | C5 | |
| 13 | 14.460 | 130061625 | 2-Methylpentane | 2.02 | C6 | 5.72 |
| 14 | 14.611 | 71435879 | 3-Methylpentane | 1.11 | C6 | |
| 15 | 14.830 | 112079037 | Methylcyclopentane | 1.74 | C6 | |
| 16 | 15.184 | 55334753 | Benzene | 0.86 | C6 | |
| 17 | 16.271 | 23831372 | 4,4-Dimethylcyclopentene | 0.37 | C7 | 12.64 |
| 18 | 16.371 | 49488024 | 1,3-Dimethylcyclopentane | 0.77 | C7 | |
| 19 | 16.448 | 37291418 | 3-Methylhexane | 0.58 | C7 | |

TABLE 9-continued

Hydrocarbon product distribution resulting from catalytic conversion of 1-hexanol
V-ZSM5 1-hexanol 1.0 ml/hr fresh V-ZSM5

| | | | | | | |
|---|---|---|---|---|---|---|
| 20 | 16.692 | 27463787 | 4,4-Dimethylcyclopentene | 0.43 | C7 | |
| 21 | 16.948 | 22117165 | Cycloheptane | 0.34 | C7 | |
| 22 | 17.266 | 655388903 | Toluene | 10.16 | C7 | |
| 23 | 18.267 | 15743538 | 1,2,3-Trimethylcyclopentene | 0.24 | C8 | 25.86 |
| 24 | 18.623 | 17395888 | trans-1-Ethyl-3-Methylcyclopentane | 0.27 | C8 | |
| 25 | 19.629 | 188171335 | Ethylbenzene | 2.92 | C8 | |
| 26 | 19.739 | 1177194930 | 1,3-Dimethylbenzene | 18.25 | C8 | |
| 27 | 20.315 | 270038608 | p-Xylene | 4.19 | C8 | |
| 28 | 23.133 | 581034837 | 1-Ethyl-4-methylbenzene | 9.01 | C9 | 19.79 |
| 29 | 23.369 | 346827203 | 1-Ethyl-4-methylbenzene | 5.38 | C9 | |
| 30 | 23.868 | 49227889 | 1-Ethyl-3-methylbenzene | 0.76 | C9 | |
| 31 | 24.381 | 299884596 | 1,3,5-Trimethylbenzene | 4.65 | C9 | |
| 32 | 28.561 | 102428364 | 1,4-Diethylbenzene | 1.59 | C10 | 7.35 |
| 33 | 28.930 | 74548481 | 1-Methyl-4-propylbenzene | 1.16 | C10 | |
| 34 | 29.359 | 92826453 | 1,3-Diethylbenzene | 1.44 | C10 | |
| 35 | 30.670 | 97745750 | 1-Ethyl-2,3-dimethylbenzene | 1.52 | C10 | |
| 36 | 33.494 | 106588822 | 1-Methyl-2-(2-propenyl)benzene | 1.65 | C10 | |
| 37 | 41.525 | 162311180 | 1,2-Dimethylindane | 2.52 | C11 | 3.50 |
| 38 | 61.479 | 51586655 | 1-Methylnaphthalene | 0.80 | C11 | |
| 39 | 61.574 | 11789869 | 1-Methylnaphthalene | 0.18 | C11 | |
| | total | 6451633783 | | | | |
| | % fuel | 99.72 | | | | |

| | | |
|---|---|---|
| C2+ | Aromatic | 66.02 |
| | Olefins | 8.69 |
| | Paraffins | 5.81 |
| | i-paraffins | 14.58 |
| | Naphthalenes | 0.98 |

TABLE 10

Hydrocarbon product distribution resulting from catalytic conversion of 1-heptanol
V-ZSM5 1-heptanol 1.0 ml/hr fresh V-ZSM5

| Peak # | Ret Time | Area | ID | % | | |
|---|---|---|---|---|---|---|
| 1 | 1.315 | 2069361 | N2 | | | |
| 2 | 2.276 | 10596794 | ethylene | 0.17 | C2 | 0.17 |
| 3 | 6.346 | 244017772 | Propene | 4.02 | C3 | 5.29 |
| 4 | 6.656 | 76955284 | Propane | 1.27 | C3 | |
| 5 | 9.461 | 275840219 | Isobutane | 4.55 | C4 | 15.36 |
| 6 | 9.721 | 380873144 | 2-Methyl-1-propene | 6.28 | C4 | |
| 7 | 10.077 | 191541732 | 2-Butene | 3.16 | C4 | |
| 8 | 10.222 | 82951384 | (E)-2-Butene | 1.37 | C4 | |
| 9 | 11.953 | 10984477 | 2-Methyl-1-butene | 0.18 | C5 | 11.03 |
| 10 | 12.291 | 166208231 | 2-Methylbutane | 2.74 | C5 | |
| 11 | 12.420 | 112815654 | 2-Methyl-2-butene | 1.86 | C5 | |
| 12 | 12.581 | 59040929 | cis-1,2-Dimethylcyclopropane | 0.97 | C5 | |
| 13 | 12.675 | 319636428 | 2-Methyl-2-butene | 5.27 | C5 | |
| 14 | 14.259 | 30497097 | (Z)-4-Methyl-2-pentene | 0.50 | C6 | 7.00 |
| 15 | 14.461 | 79073039 | 2-Methylpentane | 1.30 | C6 | |
| 16 | 14.651 | 109280309 | (E)-3-Methyl-2-pentene | 1.80 | C6 | |
| 17 | 14.727 | 38694370 | 3-Methylenepentane | 0.64 | C6 | |
| 18 | 14.819 | 74609172 | (E)-3-Methyl-2-pentene | 1.23 | C6 | |
| 19 | 14.863 | 75048180 | 3,3-Dimethyl-1-cyclobutene | 1.24 | C6 | |
| 20 | 15.184 | 17083427 | Benzene | 0.28 | C6 | |
| 21 | 15.895 | 19482571 | (E)-4,4-Dimethyl-2-pentene | 0.32 | C7 | 12.74 |
| 22 | 16.072 | 12210792 | (E)-2-Heptene | 0.20 | C7 | |
| 23 | 16.168 | 18645439 | 3-Methyl-3-hexene | 0.31 | C7 | |
| 24 | 16.258 | 61912414 | 4,4-Dimethylcyclopentene | 1.02 | C7 | |
| 25 | 16.368 | 78209680 | 2-Methylhexane | 1.29 | C7 | |
| 26 | 16.445 | 162106417 | 3-Methylhexane | 2.67 | C7 | |
| 27 | 16.684 | 83861374 | 4,4-Dimethylcyclopentene | 1.38 | C7 | |
| 28 | 16.864 | 9070847 | Ethylidenecyclopentane | 0.15 | C7 | |
| 29 | 16.946 | 28685305 | Cycloheptane | 0.47 | C7 | |
| 30 | 17.278 | 298503719 | Toluene | 4.92 | C7 | |
| 31 | 17.759 | 19176807 | 1-Phenyl-1-butene | 0.32 | C10 | |
| 32 | 18.035 | 25595185 | 1,2,3-Trimethylcyclopentene | 0.42 | C8 | 16.92 |
| 33 | 18.266 | 32778297 | 1,2,3-Trimethylcyclopentene | 0.54 | C8 | |
| 34 | 18.394 | 16951608 | 1-Phenyl-1-butene | 0.28 | C10 | |
| 35 | 18.478 | 21598628 | 1-Phenyl-1-butene | 0.36 | C10 | |

TABLE 10-continued

Hydrocarbon product distribution resulting from catalytic conversion of 1-heptanol
V-ZSM5 1-heptanol 1.0 ml/hr fresh V-ZSM5

| | | | | | | |
|---|---|---|---|---|---|---|
| 36 | 18.629 | 30162172 | Cyclooctene | 0.50 | C8 | |
| 37 | 19.063 | 26713507 | 1,4-Dimethyl-1-cyclohexene | 0.44 | C8 | |
| 38 | 19.639 | 110103924 | Ethylbenzene | 1.82 | C8 | |
| 39 | 19.770 | 682151582 | 1,3-Dimethylbenzene | 11.25 | C8 | |
| 40 | 20.324 | 118475680 | o-Xylene | 1.95 | C8 | |
| 41 | 23.147 | 394946090 | 1-Ethyl-4-methylbenzene | 6.51 | C9 | 15.35 |
| 42 | 23.370 | 318971487 | 1-Ethyl-4-methylbenzene | 5.26 | C9 | |
| 43 | 23.861 | 28447792 | 1-Ethyl-4-methylbenzene | 0.47 | C9 | |
| 44 | 24.390 | 188189397 | 1,3,5-Trimethylbenzene | 3.10 | C9 | |
| 45 | 28.547 | 77917138 | 1,3-Diethylbenzene | 1.29 | C10 | 8.79 |
| 46 | 28.933 | 74669522 | 1-Methyl-4-propylbenzene | 1.23 | C10 | |
| 47 | 29.371 | 122113483 | 1,3-Diethylbenzene | 2.01 | C10 | |
| 48 | 30.675 | 81875683 | 1,2-Dimethyl-4-ethylbenzene | 1.35 | C10 | |
| 49 | 33.516 | 118341019 | 4-Methylindane | 1.95 | C10 | |
| 50 | 38.193 | 177661799 | 1,7-Dimethylnaphthalene | 2.93 | C12 | 3.22 |
| 51 | 38.948 | 17708249 | 1,7-Dimethylnaphthalene | 0.29 | C12 | |
| 52 | 41.609 | 126971202 | 1-Methyl-3-(1-methyl-2-propenyl)benzene | 2.09 | C11 | 4.12 |
| 53 | 62.278 | 80461738 | Benzocycloheptatriene | 1.33 | C11 | |
| 54 | 62.364 | 19465783 | Benzocycloheptatriene | 0.32 | C11 | |
| 55 | 62.541 | 22806174 | Benzocycloheptatriene | 0.38 | C11 | |
| | total | 6062690146 | | | | |
| | % fuel | 99.83 | | | | |

| | | |
|---|---|---|
| C2+ | Aromatic | 48.48 |
| | Olefins | 32.69 |
| | Paraffins | 1.89 |
| | i-paraffins | 13.53 |
| | Naphthalenes | 3.22 |

TABLE 11

Hydrocarbon product distribution resulting from catalytic conversion of 1-octanol
V-ZSM5 1-octanol 1.0 ml/hr fresh V-ZSM5

| Peak # | Ret Time | Area | ID | % | | |
|---|---|---|---|---|---|---|
| 1 | 1.315 | 2753815 | N2 | | | |
| 2 | 2.275 | 11972060 | ethylene | 0.17 | C2 | 0.17 |
| 3 | 6.349 | 182107802 | Propene | 2.63 | C3 | 3.63 |
| 4 | 6.459 | 17063391 | H2O | 0.25 | | |
| 5 | 6.659 | 69288274 | Propane | 1.00 | C3 | |
| 6 | 9.464 | 262254399 | Isobutane | 3.79 | C4 | 12.77 |
| 7 | 9.727 | 328035215 | 2-Methylpropene | 4.74 | C4 | |
| 8 | 10.079 | 207048570 | (E)-2-Butene | 2.99 | C4 | |
| 9 | 10.225 | 87248173 | (E)-2-Butene | 1.26 | C4 | |
| 10 | 11.955 | 12218575 | 2-Methyl-1-butene | 0.18 | C5 | 11.77 |
| 11 | 12.290 | 204427790 | 2-Methylbutane | 2.95 | C5 | |
| 12 | 12.421 | 133119491 | 2-Methyl-2-butene | 1.92 | C5 | |
| 13 | 12.581 | 66601798 | cis-1,2-Dimethylcyclopropane | 0.96 | C5 | |
| 14 | 12.675 | 398769012 | 2-Methyl-2-butene | 5.76 | C5 | |
| 15 | 14.261 | 35333393 | (Z)-4-Methyl-2-pentene | 0.51 | C6 | 7.53 |
| 16 | 14.461 | 112312328 | 2-Methylpentane | 1.62 | C6 | |
| 17 | 14.651 | 130583145 | (E)-3-Methyl-2-pentene | 1.89 | C6 | |
| 18 | 14.727 | 43990792 | 3-Methylenepentane | 0.64 | C6 | |
| 19 | 14.865 | 182305876 | 3,3-Dimethyl-1-cyclobutene | 2.63 | C6 | |
| 20 | 15.185 | 9091364 | Benzene | 0.13 | C6 | |
| 21 | 15.387 | 7975132 | Cyclohexene | 0.12 | C6 | |
| 22 | 15.901 | 12498170 | (E)-3-Heptene | 0.18 | C7 | 10.24 |
| 23 | 16.074 | 7516940 | (E)-4,4-Dimethyl-2-pentene | 0.11 | C7 | |
| 24 | 16.171 | 10266713 | (Z)-3-Methyl-2-hexene | 0.15 | C7 | |
| 25 | 16.265 | 71356913 | 4,4-Dimethylcyclopentene | 1.03 | C7 | |
| 26 | 16.372 | 71236965 | 2-Methylhexane | 1.03 | C7 | |
| 27 | 16.444 | 123586327 | 3-Methylhexane | 1.78 | C7 | |
| 28 | 16.689 | 110294449 | 4,4-Dimethylcyclopentene | 1.59 | C7 | |
| 29 | 16.867 | 11831994 | Ethylidenecyclopentane | 0.17 | C7 | |
| 30 | 16.949 | 37072278 | Cycloheptane | 0.54 | C7 | |
| 31 | 17.282 | 253190159 | Toluene | 3.66 | C7 | |
| 32 | 17.555 | 11246234 | 5,5-Dimethyl-1,3-hexadiene | 0.16 | C8 | 20.91 |
| 33 | 17.739 | 31406430 | 5,5-Dimethyl-1,3-hexadiene | 0.45 | C8 | |
| 34 | 18.034 | 69362186 | 2,5-Dimethyl-2,4-hexadiene | 1.00 | C8 | |
| 35 | 18.264 | 74716725 | 1,2,3-Trimethylcyclopentene | 1.08 | C8 | |

TABLE 11-continued

Hydrocarbon product distribution resulting from catalytic conversion of 1-octanol
V-ZSM5 1-octanol 1.0 ml/hr fresh V-ZSM5

| | | | | | |
|---|---|---|---|---|---|
| 36 | 18.398 | 90556817 | 2-Methylheptane | 1.31 C8 | |
| 37 | 18.483 | 81596958 | 3-Ethylhexane | 1.18 C8 | |
| 38 | 18.628 | 64421988 | 1-Methyl-2-methylenecyclohexane | 0.93 C8 | |
| 39 | 18.891 | 35693086 | 3-Ethylhexane | 0.52 C8 | |
| 40 | 19.060 | 54425049 | 1,4-Dimethyl-1-cyclohexene | 0.79 C8 | |
| 41 | 19.519 | 9790902 | 1,2-Dimethylcyclohexene | 0.14 C8 | |
| 42 | 19.641 | 97391737 | Ethylbenzene | 1.41 C8 | |
| 43 | 19.775 | 756361951 | 1,3-Dimethylbenzene | 10.92 C8 | |
| 44 | 20.330 | 70973947 | p-Xylene | 1.02 C8 | |
| 45 | 21.030 | 14645002 | 3,3,5-Trimethylcyclohexene | 0.21 C9 | 16.26 |
| 46 | 21.247 | 5154430 | | 0.07 C9 | |
| 47 | 23.142 | 400895855 | 1-Ethyl-4-methylbenzene | 5.79 C9 | |
| 48 | 23.357 | 506387684 | 1-Ethyl-4-methylbenzene | 7.31 C9 | |
| 49 | 24.395 | 198856673 | 1,3,5-Trimethylbenzene | 2.87 C9 | |
| 50 | 28.519 | 101047815 | 1,3-Diethylbenzene | 1.46 C10 | 8.21 |
| 51 | 28.904 | 127766865 | 1-Methyl-4-propylbenzene | 1.85 C10 | |
| 52 | 29.336 | 206215236 | 1,3-Diethylbenzene | 2.98 C10 | |
| 53 | 30.665 | 86602696 | 1-Isopropyl-2-methylbenzene | 1.25 C10 | |
| 54 | 33.486 | 46744377 | 1-methyl-4-(2-propenyl)-Benzene | 0.68 C10 | |
| 55 | 36.418 | 419441891 | 1,4,5-Trimethylnaphthalene | 6.06 C13 | 8.04 |
| 56 | 41.628 | 137263999 | 1-Isopropylnaphthalene | 1.98 C13 | |
| 57 | 62.492 | 32344606 | Benzocycloheptatriene | 0.47 C11 | 0.47 |
| | total | 6924845236 | | | |
| | % fuel | 99.83 | | | |

| | | |
|---|---|---|
| C2+ | Aromatic | 42.001 |
| | Olefins | 31.514 |
| | Paraffins | 1.707 |
| | i-paraffins | 16.068 |
| | Naphthalenes | 8.039 |

While there have been shown and described what are at present considered the preferred embodiments of the invention, those skilled in the art may make various changes and modifications which remain within the scope of the invention defined by the appended claims.

What is claimed is:

1. A method for producing a hydrocarbon blendstock, the method comprising contacting at least one saturated acyclic alcohol with a metal-loaded zeolite catalyst at a temperature of at least 100° C. and up to 550° C., wherein said metal is a positively-charged metal ion, said metal-loaded zeolite catalyst is catalytically active for converting said alcohol to said hydrocarbon blendstock, and said saturated acyclic alcohol is selected from the group consisting of n-pentanol, n-hexanol, n-heptanol, n-octanol, n-nonanol, n-decanol, isopentanol, 2-pentanol, 3-pentanol, neopentyl alcohol, isohexanol, 2-hexanol, 3-hexanol, isoheptanol, 2-heptanol, 3-heptanol, 4-heptanol, 6-methylheptanol, and 2-ethylhexanol, wherein said method directly produces said hydrocarbon blendstock, and said hydrocarbon blendstock has less than 1 vol % ethylene, at least 35 vol % of hydrocarbon compounds containing at least eight carbon atoms and no more than 1 vol % benzene, and wherein said hydrocarbon blendstock substantially corresponds to a petrochemical fuel.

2. The method of claim 1, wherein said at least one saturated acyclic alcohol is a component of an aqueous solution or biphasic system.

3. The method of claim 1, wherein said at least one saturated acyclic alcohol is a component of an aqueous solution or biphasic system in a concentration of no more than about 40%.

4. The method of claim 3, wherein said concentration is no more than about 20%.

5. The method of claim 3, wherein said concentration is no more than about 10%.

6. The method of claim 3, wherein said aqueous solution is a water saturated solution of the at least one saturated acyclic alcohol.

7. The method of claim 2, wherein said at least one saturated acyclic alcohol is a component of a fermentation stream when contacted with said metal-loaded zeolite catalyst.

8. The method of claim 1, wherein said metal is selected from alkali metal, alkaline earth metal, copper, iron, vanadium, zinc, titanium, cadmium, gallium, indium, and combinations thereof.

9. The method of claim 1, wherein said metal is selected from copper, iron, and vanadium.

10. The method of claim 1, wherein said zeolite comprises a pentasil zeolite.

11. The method of claim 10, wherein said pentasil zeolite comprises ZSM5.

12. The method of claim 1, wherein said metal-loaded zeolite catalyst comprises Cu-ZSM5.

13. The method of claim 1, wherein said metal-loaded zeolite catalyst comprises V-ZSM5.

14. The method of claim 1, wherein said petrochemical fuel is selected from gasoline, kerosene, diesel, and jet propellant.

15. The method of claim 1, wherein said method further comprises distilling said hydrocarbon blendstock to obtain a fraction of said hydrocarbon blendstock.

16. The method of claim 1, wherein said method directly produces a hydrocarbon blendstock having at least 40 vol % of hydrocarbon compounds containing at least eight carbon atoms.

17. The method of claim 1, wherein said method directly produces a hydrocarbon blendstock having at least 50 vol % of hydrocarbon compounds containing at least eight carbon atoms.

18. The method of claim 1, wherein said method directly produces a hydrocarbon blendstock having less than 8 vol % of hydrocarbon compounds having three carbon atoms.

19. The method of claim 1, wherein said method directly produces a hydrocarbon blendstock having less than 5 vol % of hydrocarbon compounds having three carbon atoms.

20. The method of claim 1, further comprising treating said hydrocarbon blendstock with a benzene alkylation catalyst, under conditions suitable for alkylating benzene, to reduce the level of benzene in said hydrocarbon blendstock.

21. The method of claim 1, wherein said metal-loaded zeolite does not include lanthanum.

22. The method of claim 1, wherein said method directly produces a hydrocarbon blendstock having at least 40 vol % of hydrocarbon compounds containing at least eight carbon atoms and having less than 8 vol % of hydrocarbon compounds having three carbon atoms.

23. The method of claim 1, wherein said method directly produces a hydrocarbon blendstock having at least 50 vol % of hydrocarbon compounds containing at least eight carbon atoms and having less than 5 vol % of hydrocarbon compounds having three carbon atoms.

* * * * *